US005427040A

United States Patent [19]

Abe et al.

[11] Patent Number: 5,427,040

[45] Date of Patent: Jun. 27, 1995

[54] METHOD OF AND APPARATUS FOR CONTROLLING AN AUTOMATIC SEWING MACHINE

[75] Inventors: Tomonori Abe; Yoshifumi Nishizawa; Iwao Yamane, all of Nagoya, Japan

[73] Assignee: Mitsubishi Denki Kabushiki Kaisha, Tokyo, Japan

[21] Appl. No.: 953,071

[22] Filed: Sep. 29, 1992

[30] Foreign Application Priority Data

Nov. 5, 1991 [JP] Japan ..... 3-288634

[51] Int. Cl.[6] ..... D05B 21/00

[52] U.S. Cl. ..... 112/121.12; 112/262.3

[58] Field of Search ..... 112/121.12, 121.11, 112/103, 453, 456, 262.3, 262.1, 266.1

[56] References Cited

U.S. PATENT DOCUMENTS

| | | | |
|---|---|---|---|
| 4,340,002 | 7/1982 | Hanyu et al. | 112/453 |
| 4,616,583 | 10/1986 | Takano et al. | 112/121.12 |
| 4,683,827 | 8/1987 | Kinoshita et al. | 112/121.12 |

FOREIGN PATENT DOCUMENTS

| | | |
|---|---|---|
| 3022904 | 1/1981 | Germany . |
| 3213277 | 11/1982 | Germany . |
| 3527454 | 2/1986 | Germany . |
| 3490617 | 3/1986 | Germany . |
| 61-37281 | 2/1985 | Japan . |
| 60-29515 | 7/1985 | Japan . |
| 60-54076 | 11/1985 | Japan . |
| 63-277084 | 11/1988 | Japan . |
| 3006531 | 1/1991 | Japan . |
| 3148676 | 6/1991 | Japan . |
| 339187 | 8/1991 | Japan . |

*Primary Examiner*—Peter Nerbun

*Attorney, Agent, or Firm*—Sughrue, Mion, Zinn, Macpeak & Seas

[57] ABSTRACT

In a method of and an apparatus for drivingly controlling an automatic sewing machine, the time for which a work holding unit is drivingly processed every seam lengths, the time from start of the drive processing of the work holding unit to the time at which the work holding unit starts movement, and the time of movement of the work holding unit are set whereby a drive signal of the work holding unit is controlled such that the work holding unit starts movement and is terminated in movement during a period for which a needle passes through a sewing material. Decision of the drive signal of the work holding unit is executed by a program with respect to all sewing speeds for all sewing lengths.

16 Claims, 24 Drawing Sheets

ROM 7b DATA MAP

| ADDRESS | DATA TABLE |
|---|---|
| ( a ) | PULSE DATA TABLE |
| ( b ) | COUNT-BORROW DATA TABLE (1) |
| ( c ) | COUNT-BORROW DATA TABLE (2) |
| ( d ) | COUNT-BORROW DATA TABLE (3) |
| ⋮ | |
| ( o ) | COUNT-BORROW DATA TABLE (15) |
| ( p ) | SPEED LIMIT DATA TABLE |
| ( q ) | FEED-TIME DATA TABLE |

ROM 7b DATA MAP

COUNT-BORROW DATA TABLE (ADDRESS (a)~(o))

COUNT-BORROW DATA TABLE (1)

| EXAMPLE SEAM LENGTH / SPEED | X-AXIS 0.1 | 0.2 | 12.7 (mm) |
|---|---|---|---|
| 2000 | 50~100 | 40~90 | 10~80 |
| 1800 | 40~110 | 30~100 | 5~90 |
| ⋮ | ⋮ | ⋮ | ⋮ |
| 200 (rpm) | 20~120 | 10~110 | 5~100 |

X-AXIS

| MOVING DIRECTION OF CLOTH RETAINING UNIT / FLAG | → | ← | STOP AT A, B | STOP AT C, D |
|---|---|---|---|---|
| XP-FLG | 1 | 0 | 1 | 0 |
| XN-FLG | 0 | 1 | 1 | 0 |

Y-AXIS

| MOVING DIRECTION OF CLOTH RETAINING UNIT / FLAG | ↑ | ↓ | STOP AT A, D | STOP AT B, C |
|---|---|---|---|---|
| YP-FLG | 1 | 0 | 1 | 0 |
| YN-FLG | 0 | 1 | 1 | 0 |

FIG. 10

ADDRESS AND FLAG CONDITION

| ADDRESS | FLAG CONDITION (XP-FLG, XN-FLG, YP-FLG, YN-FLG) |
|---|---|
| d | ( 1 , 0 , 1 , 1 ) |
| e | ( 0 , 1 , 1 , 1 ) |
| ⋮ | ⋮ |
| o | ( 0 , 1 , 0 , 0 ) |

FIG.20(a) PRIOR ART

ROM 7b DATA

| ADDRESS | DATA TABLE | |
|---|---|---|
| ( a ) | PULSE DATA | 220 |
| ( b ) | COUNT-BORROW DATA | 221 |
| ( c ) | SPEED LIMIT DATA | 222 |

FIG.20(b) PRIOR ART

| SPEED \ SEAM LENGTH | 0.1 | 0.2 | 0.3 | 0.4 | --- | --- | 12.5 | 12.6 | 12.7 (mm) |
|---|---|---|---|---|---|---|---|---|---|
| 2000 | 100 | 99 | 98 | 97 | --- | --- | 40 | 39 | 38 |
| 1800 | 105 | 104 | 103 | 102 | --- | --- | 45 | 46 | 47 |
| 1600 | — | — | — | — | --- | --- | — | — | — |
| ⋮ | ⋮ | ⋮ | ⋮ | ⋮ | | | ⋮ | ⋮ | ⋮ |
| 400 | 132 | 131 | 130 | 129 | --- | --- | 60 | 59 | 58 |
| 200 | 130 | 129 | 128 | 127 | --- | --- | 65 | 64 | 63 |

(rpm)

METHOD OF AND APPARATUS FOR CONTROLLING AN AUTOMATIC SEWING MACHINE

FIELD OF THE INVENTION

This invention relates to a method of and an apparatus for controlling an automatic sewing machine, in which work holding means clamping a workpiece is drivingly controlled to form seams.

BACKGROUND OF THE INVENTION

FIG. 17 of the drawings attached thereto is an external view of a conventional general automatic sewing machine. The reference numeral 201 denotes a sewing machine table; 202, a needle; and 203, a thread take-up lever. A sewing-machine head 25 incorporates a mechanism for forming seams on a sewing material on an upper face of the sewing machine table 201 by the needle 202. A sewing-machine-head drive motor (hereinafter referred to as "drive motor") 24 drives the sewing-machine head 25. A sewing-machine detector 26 is arranged at an end of a spindle (not shown) of the sewing-machine head 25 for generating a signal in synchronism with rotation of the spindle of the sewing machine. An upper holder plate 204 and a lower holder plate 205 are provided for the sewing material. A work holding unit 206 retains and clamps the sewing material between the upper holding plate 204 and the lower holder plate 205 by air or the like. A bi-axial drive mechanism 208 two-dimensionally moves the work holding unit 206 on a slide plate 207 in accordance with a predetermined pattern. Origin detecting units 29 and are arranged on the bi-axial drive mechanism 208 for detecting mechanical origins of two respective axes. A control unit 209 generally controls operation of the above-described drive mechanism.

Incorporated in the control unit 209 are power switches 211 and a floppy disk drive 47 (hereinafter referred to as "FDD") for executing reading and writing with respect to a floppy disc (hereinafter referred to as "FD") 48 (not shown in FIG. 17). A foot pedal 31 and the like are connected to the magnetic-memory writing unit 47. Connected also to the magnetic-memory writing unit 47 are an operating panel 40 on which various switches for specifying the operating contents of the automatic sewing machine are set, a start switch 216 for giving a sewing start command, and a switch (hereinafter referred to as "work holding switch") 214 for holding and clamping the work holding unit 206.

Arranged on the operating panel 40 are a liquid-crystal display (hereinafter referred to as "LCD") 217 for displaying, on a screen, information such as operating procedure, messages, current sewing conditions and the like, a reset switch 212 for positioning the bi-axial drive mechanism 208 to a predetermined position to reset a system, a test switch 213 for driving the two axes in accordance with sewing data without rotation of the spindle of the sewing machine, a speed setting switch 218 for changing a rotational speed of the drive motor 24 at sewing, and a group of various switches 210 for assigning preparation, calling, erasing and the like of predetermined sewing related data.

FIG. 18 is a circuit diagram showing a schematic arrangement within the control unit 209. A microcomputer 1 includes a CPU (central processing unit) executing computation, an interrupt controller from the outside, and a direct memory access (hereinafter referred to as "DMA") for directly reading a memory without intervention of the CPU from the outside. A quartz or crystal oscillator 32 generates a fundamental frequency operating the microcomputer 1. A memory element (hereinafter referred to as "RAM") 6 is provided which is readable and writable, and a nonvolatile memory element (hereinafter referred to as "ROM") 7 is provided which is reading only. A memory address latch circuit 2 latches (self-retains) addresses of the memories (RAM 6 and ROM 7). A memory data buffer 3 transfers data from the memories (RAM 6 and ROM 7) to the microcomputer 1, or data from the microcomputer 1 to the memories (RAM 6 and ROM 7). A peripheral data buffer 4 transfers data from the microcomputer 1 to peripheral elements other than the memories (RAM 6 and ROM 7), or from the peripheral elements to the microcomputer 1. An IC select signal generating circuit (hereinafter referred to as "decoder") 5 generates an IC select signal for singly selecting the memories (RAM 6 and ROM 7) and the peripheral elements.

Further, a keyboard controller 37 controls the group of switches 210 of the operating panel 40, the speed setting switch 218 and the reset switch 212. An interface circuit 38 is provided for inputting and outputting signals of the keyboard controller 37. An LCD controller 41 drives the LCD 217 within the operating panel 40. An interface circuit 42 is provided for outputting from the LCD controller 41 and inputting from the LCD 217. An I/O 8 controls various parallel input and output signals. A pulse circuit (hereinafter referred to as "count borrow circuit") 45 generates timing at which pulses are generated by data outputted from the I/O 8 and the signal from the detector 26. Input interface circuits 10, 11 and 12 are provided into which various control signals are inputted and from which the various control signals are inputted to the I/O 8.

Further, an interrupt controller 44 receives signals from the keyboard controller 37, the count borrow circuit 45 and the detector 26 through the input interface circuit 10, to generate an interrupt signal to the microcomputer 1. A floppy disc controller (hereinafter referred to as "FDC") 46 transmits a signal to the FDD 47 and receives the signal therefrom. The FDD 47 writes data to the FD 48 that is a recording medium, by a signal from the FDC 46. A PMD 13 drives stepping motors 27 and 28 of the bi-axial drive mechanism 208 of the sewing machine. A circuit (hereinafter referred to as "motor control circuit") 49 controls the drive motor 24. A power circuit section 50 receives a signal from the motor control circuit 49 to operate the drive motor 24. A switch section (hereinafter referred to as "group of control-method switches") 15 executes setting for changing a control method of the sewing machine. A power circuit 16 supplies a power to the control unit 209.

FIG. 19 shows the count-borrow circuit 45 illustrated in FIG. 18. Components and parts which are the same as or identical with those shown in FIG. 18 are designated by the same or like reference numerals, and the description of the same or identical components and parts will be omitted. A down counter 101 reads data inputted from the CPU through the I/O 8 to count PG signals inputted from the detector 26 through the input interface circuit 10 by a set value. The down counter 101 outputs a signal when the counter is set or when the contents of the counter are brought to 0 (zero). An AND circuit 102 with inverted input and output serves not to output a signal when the down counter is set. A flip-flop circuit 103 is provided for latching (self-holding) the signal from the down counter 101.

FIG. 20(*a*) shows a data map within the ROM 7. The ROM 7 is divided into a system ROM 7*a* and a data ROM 7*b* as shown in FIG. 18. A program for operating the CPU and the like is stored in the system ROM 7*a*, while pulse data (hereinafter referred to as "feed pulses data") 220 of the bi-axial drive mechanism 208 stored and computed previously in another step, activation timing data (hereinafter referred to as "count-borrow data") 221, and sewing-speed limit data (hereinafter referred to as "speed limit data") 222 of the sewing machine are stored in the data ROM 7*b*. These data are conventional in a variety of automatic sewing machines. As shown in FIG. 20(*b*), optimum data for a seam length of 0.1–12.7 mm and sewing speeds from 2,000–200 rpm are stored in the data ROM 7*b*.

Operation of the conventional automatic sewing machine constructed as above will be described below. In this connection, the detailed operation of the circuit diagram shown in FIG. 18 is described in Japanese Patent Publication No. SHO 60-29515 and Japanese Patent Publication No. SHO 60-54076, and the detailed description of the operation will be omitted here. Description will be made centering around control operation of the bi-axial drive mechanism 208.

FIGS. 21, 22 and 23 are flow charts showing control operation of the bi-axial drive mechanism 208 of the conventional automatic sewing machine. FIG. 24 is a timing chart of the bi-axial drive mechanism 208, while FIG. 25 is a schematic flow chart of a count-borrow deciding method.

As illustrated in FIG. 24, a signal 401 outputted from the detector 26 is a needle upper-position signal (hereinafter referred to as "UP signal") outputted at an upper position of the needle 202, a signal 402 outputted from the detector 26 is a needle lower-position signal (hereinafter referred to as "DN signal") outputted at a lower position of the needle 202, and a signal 404 outputted from the detector 26 is a PG signal outputted in synchronism with the rotational speed of the sewing machine, while a signal 405 is a fundamental interrupt signal for controlling the PMD 13 which drives the stepping motors 27 and 28. A signal (hereinafter referred to as "BR signal") 403 controls drive timings of the respective stepping motors 27 and 28. A signal (hereinafter referred to as "stepping-motor drive signal") 406 shows a condition under which the stepping motor 27 (28) of an X-axis (Y-axis) is driven. Furthermore, waveforms 407 assume moving locus, in an X-direction and a Y-direction, of the work holding unit 206 on the slide plate 207, respectively. A waveform 408 indicates a locus of vertical movement of the thread take-up lever 203. A waveform 409 indicates a moving locus of a forward end of the needle 202.

FIG. 21 shows activation-inhibiting pulse-number setting processing (hereinafter referred to as "DN-signal interrupt processing") which is activated by detection of the DN signal 402 by the detector 26, and FIG. 22 shows fundamental interrupt-signal outputting processing (hereinafter referred to as "count-borrow interrupt processing") which is activated by outputting of the BR signal 403, while FIG. 23 shows stepping-motor drive processing which is activated by outputting of the fundamental interrupt signal.

Now, a start switch 216 is turned on whereby sewing operation is started in accordance with the sewing pattern data, the sewing speed and the like programmed beforehand. First, in FIG. 24, when the drive motor 24 drives the sewing-machine head 25, the DN signal 402 is outputted from the detector 26. The DN signal is detected whereby the DN-signal interrupt processing illustrated in FIG. 21 starts. First, a sewing speed and a sewing length of next or subsequent one stitch are fetched to the memory within the microcomputer 1 (S501). Subsequently, a number of pulses (hereinafter referred to as "CBR") corresponding to the sewing speed and the sewing length, at which processing is ended when the forward end of the needle 202 passes through the slide plate 207 (G1), are fetched to the memory (S502). The microcomputer sets the CBR to the down counter 101 shown in FIG. 19 (S503) and, simultaneously, the reset signal is set to the flip-flop circuit 103. Thus, the processing is completed.

At the time the CBR is set to the down counter 101, the BR signal 403 in FIG. 24 is brought to a low level (403*a*). Whenever the PG signal 404 is inputted into the down counter 101 from the detector 26 through the input interface 10, the set CBR is subtracted. When the result of the subtraction is brought to zero, the down counter 101 outputs a pulse signal from the BR-signal output terminal. By the pulse signal, the BR signal that is the output signal from the flip-flop circuit 103 is inverted so that the BR signal is brought to a high level (403*b*).

By the fact that the BR signal 403 is inverted to the high level (403*b*), the fundamental interrupt-signal outputting processing shown in FIG. 22 starts. In this processing, outputting of the fundamental interrupt signal 405 for controlling the PMD 13 is permitted to leave the processing (S504).

By the fact that the fundamental interrupt signal 405 is outputted, the stepping-motor drive processing illustrated in FIG. 23 starts. That is, the stepping-motor drive processing is executed whenever a rise point 405*a* of the fundamental interrupt signal 405 is detected. First, it is judged whether or not the stepping motor 27 of the X-axis is completed in movement corresponding to a seam length of one stitch (S505). If the stepping motor 27 of the X-axis is completed in movement at this time, the program branches to a step S507, while, if the stepping motor 27 is not completed in movement, the program proceeds to a step S506. The program next proceeds to a subroutine for executing drive processing of the stepping motor 27 on the side of the X-axis (S506). In this connection, the description of the stepping-motor drive processing will be omitted here. Subsequently, it is judged whether or not the stepping motor 28 in the Y-axis is completed in movement (S507). If the stepping motor 28 is completed in movement, the program branches to a step S509. If the stepping motor 28 is not completed in movement, the program proceeds to a step S508 where the program proceeds to a subroutine for executing drive processing of the stepping motor 28 on the side of the Y-axis (S508). It is judged whether or not both the stepping motors on the respective sides of the X-axis and Y-axis are completed in movement corresponding to the seam length of one stitch (S509). If the stepping motors are completed in movement, outputting of the fundamental interrupt signal 405 is inhibited to leave the processing (S510). Moreover, if any one of the movements in the X-axis and Y-axis is not ended, processing is resumed.

The CBR deciding method will be described. As shown in FIG. 25, stepping-motor drive-signal outputting time (hereinafter referred to as "FEED time") corresponding to each seam length is read (S551). Subsequently, the program enters a routine for computing a CBR range or area (S552). Here, the smallest value (hereinafter referred to as "C") of the CBR is decided depending upon a period from a time at which the DN signal 402 is outputted to a time at which the forward end of the needle 202 passes through the sliding slope 207 (G1). The largest value (hereinafter referred to as "D") of the CBR is decided depending upon a period from a time at which the DN signal 402 is outputted (402*a*) to a time at which the forward end of the needle 202 enters the sliding plate 207 (G2) and the FEED time. This processing is executed regarding all the sewing speeds for every seam length. The dimensions or sizes of C and D at all sewing speeds for each seam length are compared with each other (S553). If $0<C\leqq D$, the program branches to a step 555, while, if $C>D$, the program proceeds to a step 554. Subsequently, C is set such that $C=D$ (S554). All C and D of each seam length for every sewing speed are decided (S555) so that processing is ended.

The CBR is capable of being set within a range of $C=D$ by a digital switch (not shown). A rise of the BR signal has a range of from 403*b* indicated by the solid line to 403*c* indicated by the broken line. Further, an outputting period of time of the stepping-motor drive signal 406, corresponding to the rise, has a range of from the solid line (406*a*) to the broken line (406*b*).

In the conventional automatic sewing machine described above, there are problems in the relationship between the timing at which the drive processing of the stepping motor starts and the operation of the work holding unit 206, owing to the above-described control operation. These problems will be described with reference to FIGS. 24 and 26.

Now, it is assumed as an example that sewing of the sewing pattern only in one axis direction (X-axis direction) as shown in FIG. 26 is executed. In FIG. 26, the reference character L denotes a seam length of one stitch. A waveform, at which the stepping-motor drive processing at this time is converted into the moving distance, is denoted by 410 in FIG. 24. Further, it is assumed that the moving locus of the work holding unit 206 is one like 407. The output timing of the stepping-motor drive signal 406 as represented by the solid line (406*a*) and the broken line (406*b*) is capable of being set within the range between within G1 and G2 by the digital switch. Correspondingly thereto, the waveform 410, by which the stepping-motor drive processing is converted to the moving distance, is capable of being varied within 410*a*–410*b*, while the moving locus 407 of the work holding unit 206 is capable of being varied within a range of from 407*a*–407*b*. 407*a* indicates that movement of the work holding unit is executed during the period of time for which the forward end of the needle 202 passes out of the sewing material, while 407*b* indicates that moving of the work holding unit is executed also during the period of time for which the forward end of the needle 202 is in the sewing material.

Generally, the drive processing timings of the stepping motors and the moving timing of the work holding unit do not coincide with each other because of friction of the work holding unit, the load inertia, torsion and oscillation of a shaft of the drive section, and the like so that the timing at which the work holding unit starts movement is later or slower than the timing at which the drive processing of the stepping motor starts. Furthermore, these have variation due to the moving direction and the moving locations of the work holding unit.

Generally, a period during which the work holding unit 206 is capable of moving is decided depending upon the position of the needle. That is, as shown in FIG. 24, a period from the point (G1) where the forward end of the needle 202 passes out of the sewing material to the point (G2) at which the forward end of the needle 202 is again stuck into the sewing material is a period during which the work holding unit 206 is capable of moving. If the work holding unit 206 moves while the needle 202 is stuck into the sewing material, it is apparent that sewing rhythm does not become constant by curvature of a needle, damage of the needle due to contact between the needle and a hook (not shown) and occurrence of needle breakage and the like so that fine seams cannot be formed.

In view of the above-described factors, it is easily considered that the ideal and most desirable moving timing of the work holding unit is as 407*a*. The time at which the work holding unit starts to move is a time after the forward end of the needle 202 has passed out of the sewing material (G1), and the time at which the work holding unit has completed in movement is a time before the forward end of the needle 202 is stuck into the sewing material (G2).

As the reference technical literatures relating to the present invention, there are "Control unit For Feed Of Sewing Machine" disclosed in Japanese Patent Laid-Open No. SHO 61-37281, in addition to those mentioned previously.

Since the conventional apparatus for controlling the automatic sewing machine has been arranged as described above, there are the following problems. Specifically, since only the time during which the stepping motor is driven is processed, actual moving timing of the work holding unit is unknown. As a result, sewing quality does not become constant, a the visual quality of the seams is reduced, operability is inferior, and there is a limit in operation speed.

SUMMARY OF THE INVENTION

It is therefore an object of the invention to provide a method of controlling an automatic sewing machine, in which the time (hereinafter referred to as "table rise-delay time A") from a start point of drive processing of a motor to the time at which a work holding unit starts movement, and the moving time (hereinafter referred to as "table moving time E") of the work holding unit are made clear or definite whereby sewing rhythm is constant so that operability and an operating speed can be improved without the quality of the seams being damaged.

It is another object of the present invention to provide an apparatus for controlling an automatic sewing machine, which carries the above-described method into practice.

The method of and the apparatus for controlling the automatic sewing machine, according to the invention, are arranged such that the table rise-delay time A, and the table moving time E are set whereby the timing at which the cloth retaining unit is driven is controlled.

The apparatus for controlling the automatic sewing machine, according to the invention, is arranged such that the moving timing of the cloth retaining means is controlled on the basis of the position of the needle bar.

The apparatus for controlling the automatic sewing machine, according to the invention, is arranged such that the timing at which the cloth retaining unit is driven is changed depending upon the moving direction and/or the moving location of the cloth retaining unit.

The apparatus for controlling the automatic sewing machine, according to the invention, is arranged such that the cloth retaining unit executes operation, such as sewing or the like, on the sewing pattern at least once, whereby the table rise-delay time A and the table moving time E every one stitch are automatically decided and stored, to control the timing at which the cloth retaining unit is driven every sewing pattern.

As described above, with the arrangement of the invention, there can be produced the following advantages. That is, restricting or limiting conditions regarding the activation timing of the cloth retaining unit are fulfilled, damage on the needle bar does not occur, an attempt can be made to improve the sewing rhythm of the sewing material, and operability and the operating speed can be improved.

Other objects and features of this invention will become understood from the following description with reference to the accompanying drawings.

BRIEF DESCRIPTION OF THE DRAWINGS

FIG. 10 is a view for explanation showing the data arrangement illustrated in FIG. 7 corresponding to FIG. 9;

FIG. 20(*a*) and FIG. 20(*b*) are views for explanation showing a data arrangement of data areas within memory means and the contents of count-borrow data in the conventional arrangement;

DESCRIPTION OF THE EMBODIMENTS

Figure 1:
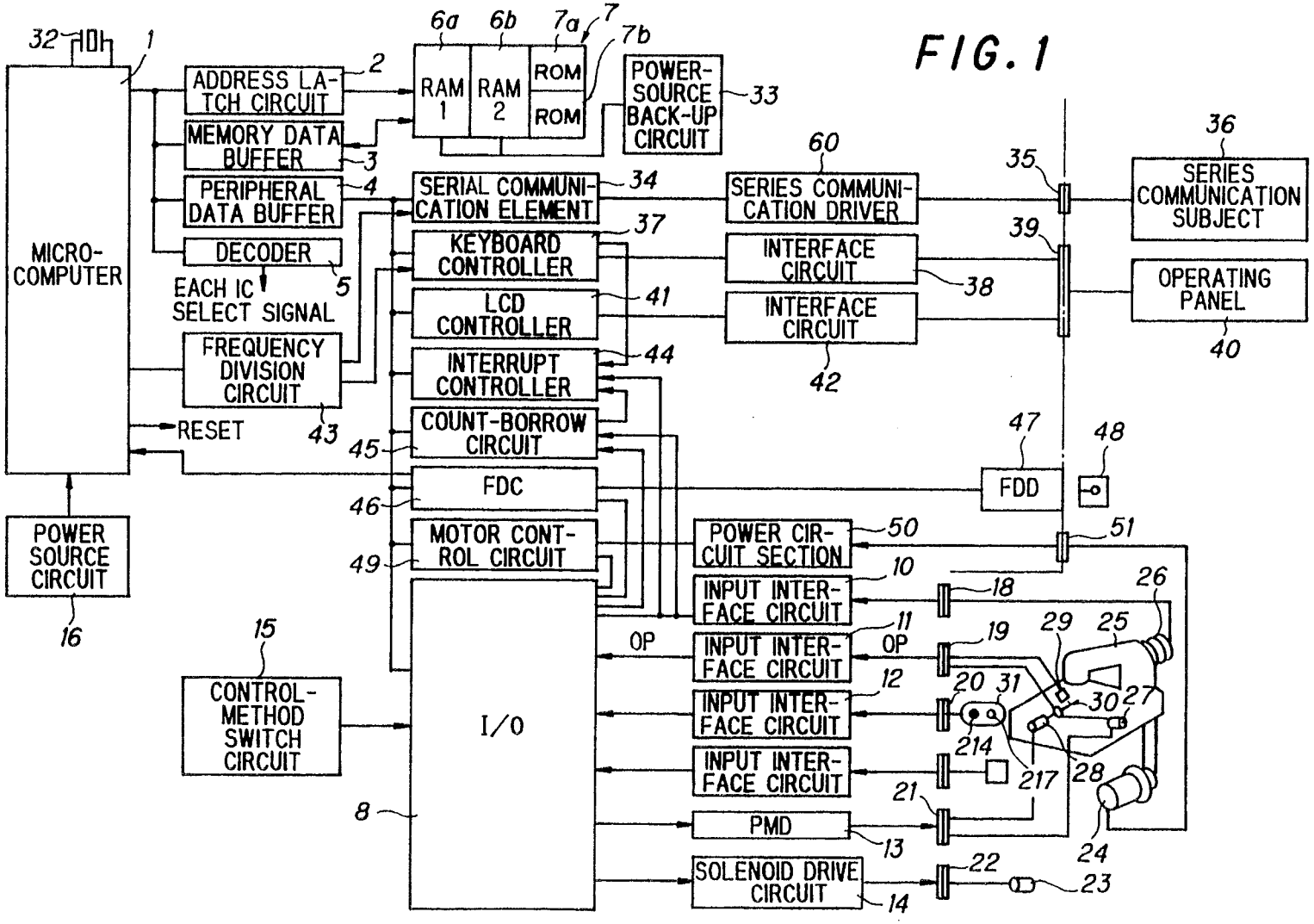
FIG. 1 is a circuit diagram showing an arrangement of an apparatus for controlling an automatic sewing machine, according to the invention.

Referring first to FIG. 1, there is shown a circuit diagram of an apparatus for controlling an automatic sewing machine, according to an embodiment of the invention. Components and parts the same as or identical with those of the conventional example are designated by the same reference numerals, and the description of the same or identical components and parts will be omitted. As shown in FIG. 1, a stack memory section (hereinafter referred to as "RAM 1") 6*a* stores data which are required to be temporarily stored when a microcomputer executes computation. A sewing-pattern data memory section (hereinafter referred to as "RAM 2") 6*b* stores sewing-pattern data. A power-source backup circuit 33 retains the contents of RAM 6 and 6*b* that a volatile memory elements, when a power source is turned off. A serial communication element 34 is connected to a peripheral data buffer 4, and converts parallel data to serial data and the serial data to the parallel data. A driver (hereinafter referred to as "serial communication driver") 60 causes data outputted from the serial communication element 34 to correspond to a communication standard (for example, RS-232C and RS-422). A unit (hereinafter referred to as "serial communication subject") 36 receives an input signal at the time of outputting of the serial communication driver 60, and issues an output signal at the time of inputting of the serial communication driver 60. Specifically, the serial communication subject 36 serves as an object for serial communication, such as a personal computer or the like. A connector 35 connects the serial communication driver 60 and the serial communication subject 36 to each other. A frequency division circuit 43 frequency-divides a signal of a constant or predetermined frequency, outputted from a microcomputer 1, to supply the frequency-divided signal to the serial communication element 34 and a keyboard controller 37.

Figure 2:
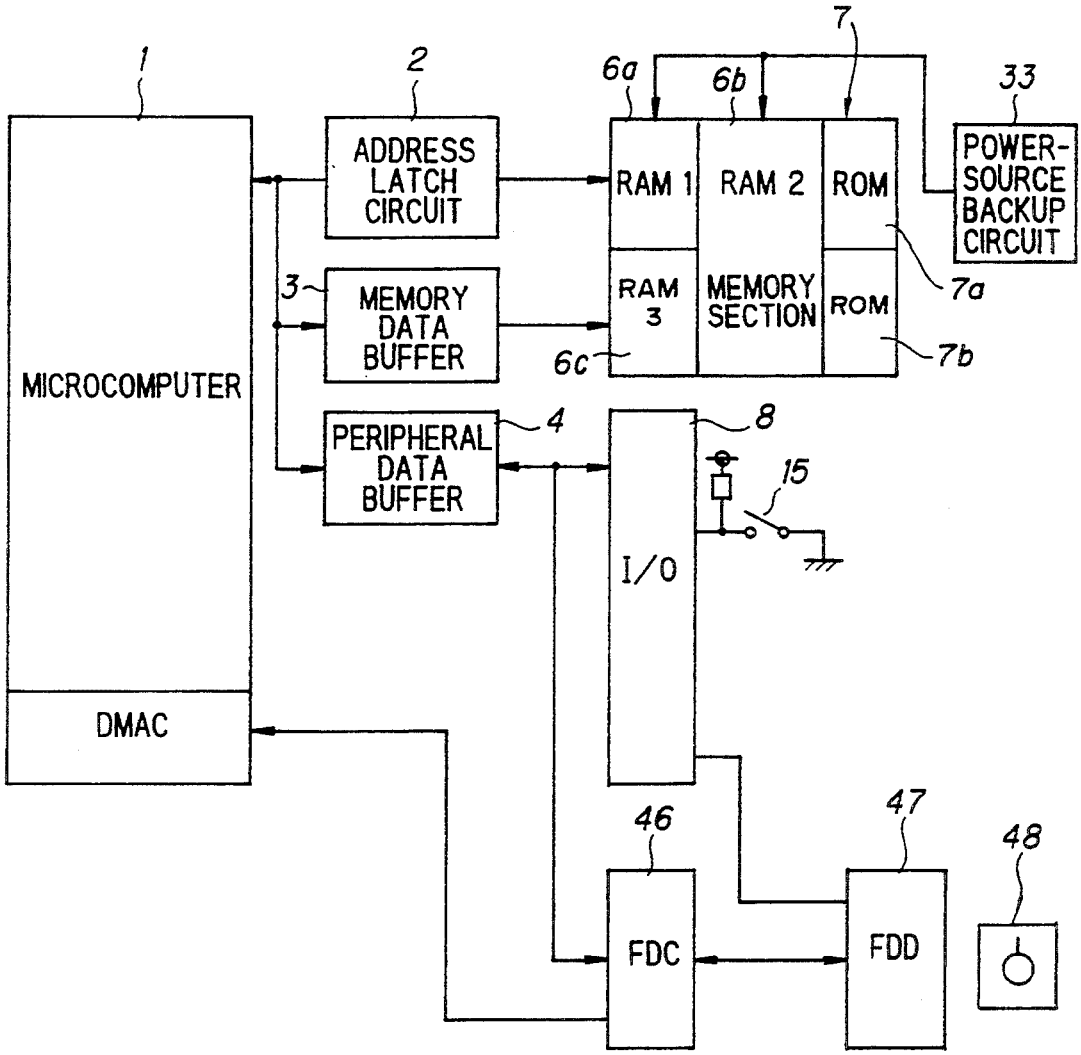
FIG. 2 is a circuit diagram showing a principal section (reading/writing operation of data) of the apparatus for controlling the automatic sewing machine, according to the invention.

FIG. 2 shows a part of the control circuit illustrated in FIG. 1. The part is a circuit for executing reading of data from the RAM 6*a*, 6*b* and a ROM 7 or a floppy disc 48, and writing of data to the RAM 6*a* and 6*b* or the floppy disc 48. In FIG. 2, the reference numerals the same as or identical with those in FIG. 1 indicate the same functions. When a switch 15 is turned on, the switch 15 changes a mode to a mode (hereinafter referred to as "CBR automatic changing mode") in which drive timing of a work holding unit is changed by a sewing direction and a sewing location of the work holding unit. A memory section (hereinafter referred to as "RAM 3") 6*c* stores sewing-pattern data after the sewing-pattern data have been optimized.

Figure 3:
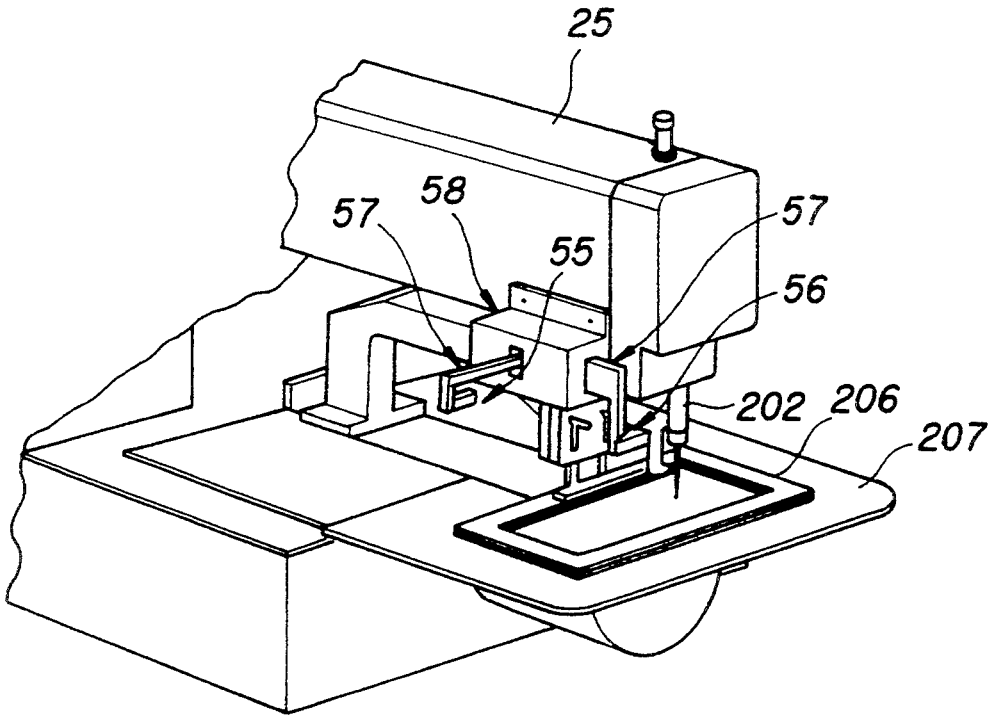
FIG. 3 is a perspective view showing an arrangement of work-holding-unit movement detecting means, according to the invention.
Figure 4:
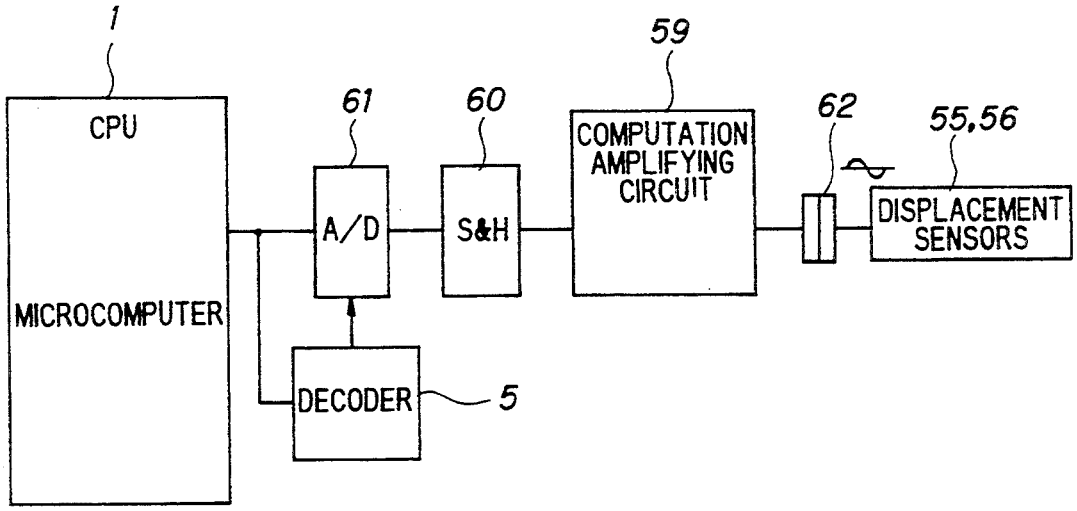
FIG. 4 is a circuit diagram showing an arrangement of the work-holding-unit movement detecting means, according to the invention.

FIGS. 3 and 4 show another embodiment. FIG. 3 is a perspective view of an automatic sewing machine which is provided with work-holding-unit movement detecting unit. As shown in FIG. 3, displacement sensors 55 and 56 detect moving conditions of the work holding unit in an X-axis direction and a Y-axis direction, respectively. A support rod 57 supports the displacement sensors 55 and 56. A control unit 58 converts displacement-condition analog signals from the respective displacement sensors 55 and 56 into digital signals, respectively, to input the converted digital signals to the microcomputer 1. FIG. 4 is a circuit diagram of the control unit 58. As shown in FIG. 4, a computation amplifying circuit 59 amplifies voltage to a voltage level suitable for analog/digital-converting (hereinafter referred to as "A/D conversion") the analog signals from the respective displacement sensors 55 and 56. A sample & hold circuit 60 holds an input signal during A/D converting operation of an A/D converter 61. The A/D convertor 61 converts the analog signal from the sample & hold circuit 60, to a digital signal. A connector 62 connects the displacement sensors 55 and 56 and the computation amplifying circuit 59 to each other.

Figure 17:
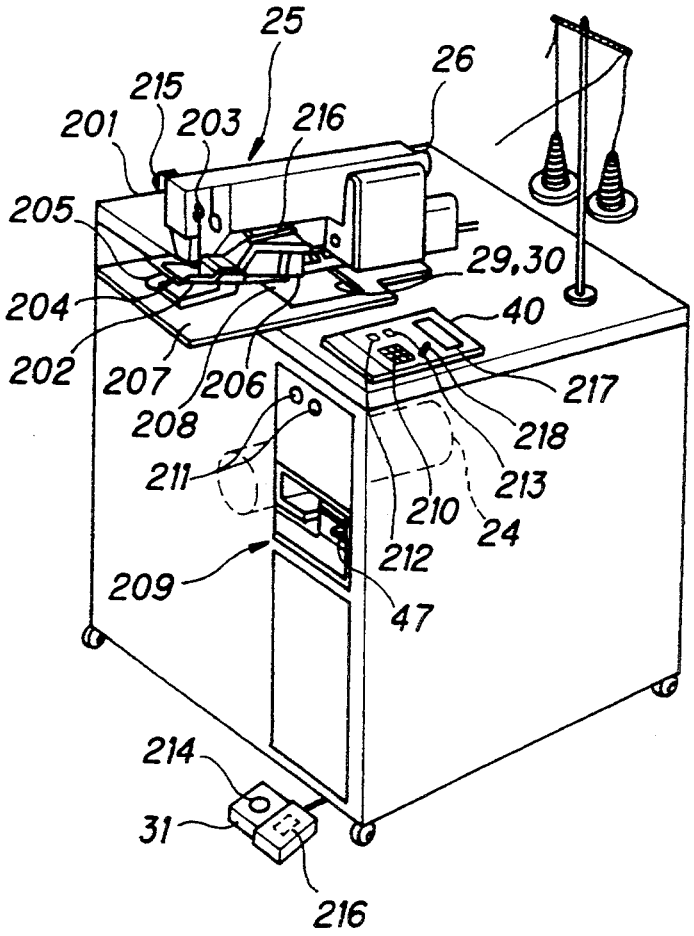
FIG. 17 PRIOR ART
FIG. 17 is a perspective view showing an external appearance of a conventional, general automatic sewing machine.
Figure 18:
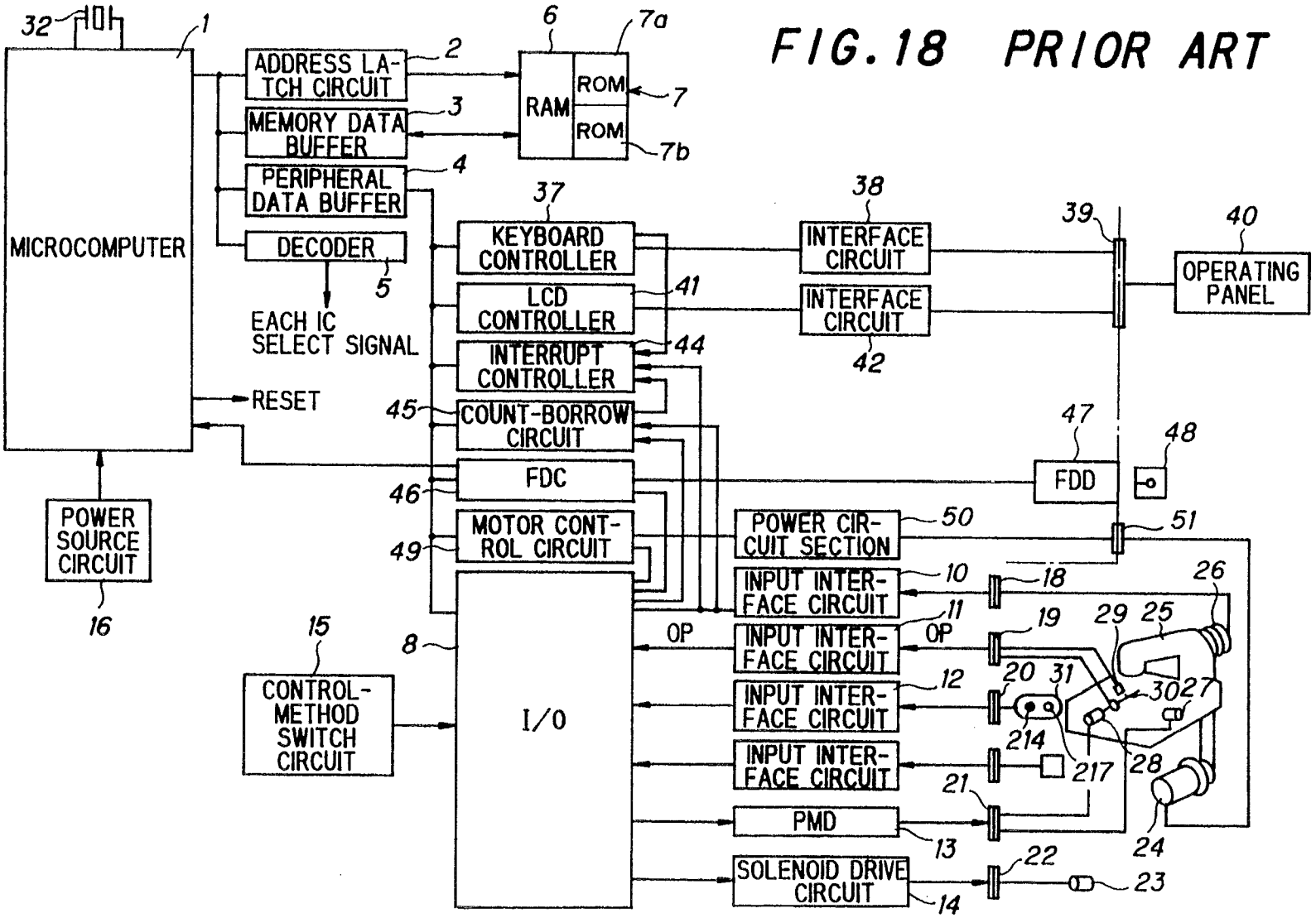
FIG. 18 PRIOR ART
FIG. 18 is a circuit diagram showing an arrangement of a control unit shown in FIG. 17.

Operation of the automatic sewing machine constructed as above will next be described. In this connection, the external appearance and the count-borrow circuit of the automatic sewing machine according to the invention are the same as those in the conventional technique, and operation will be described in combination also with the conventional design in FIGS. 17 and 18.

Figure 5:
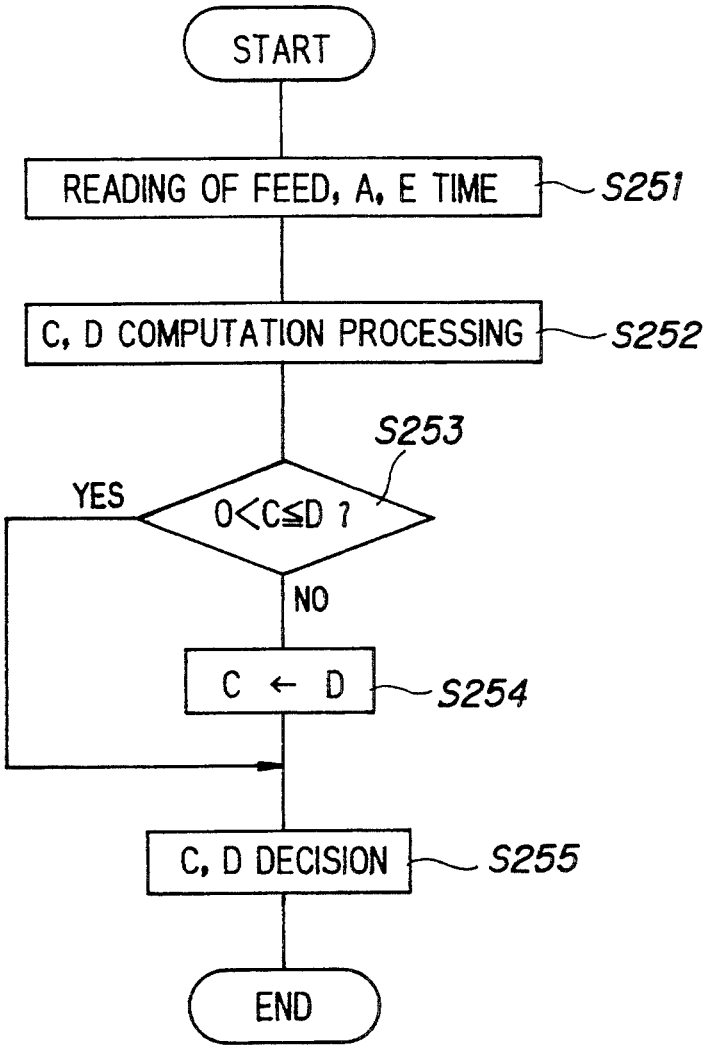
FIG. 5 is a flow chart showing schematic operation of a delay-pulse-number deciding method, according to the invention.
Figure 24:
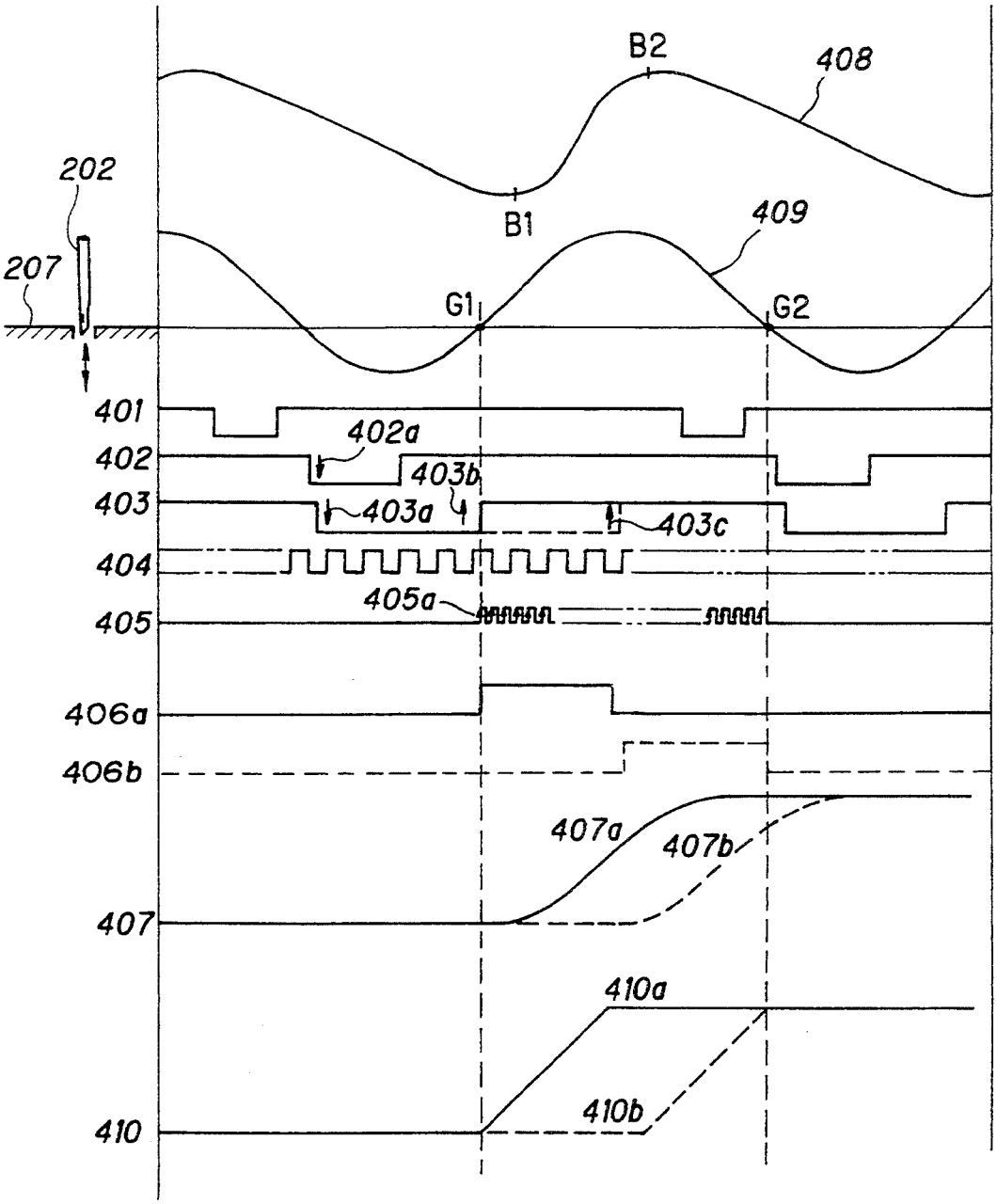
FIG. 24 PRIOR ART
FIG. 24 is a timing flow chart showing operation timing of a bi-axial drive mechanism in the conventional arrangement.
Figure 25:
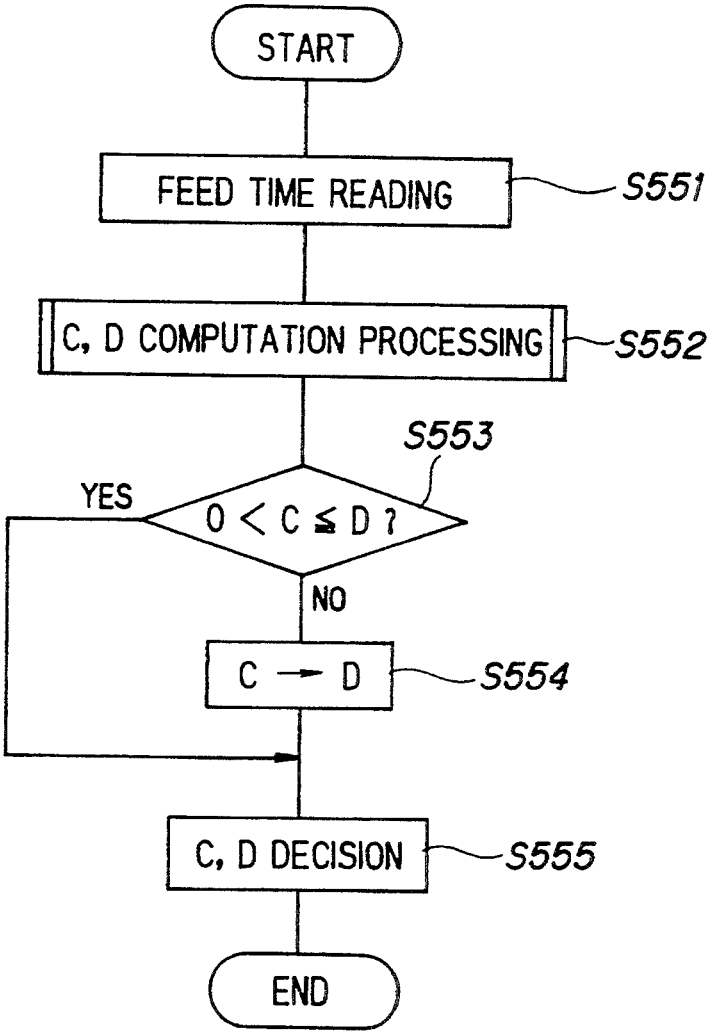
FIG. 25 PRIOR ART
FIG. 25 is a flow chart showing processing operation of a delay-pulse-number deciding method in the conventional arrangement.

FIG. 5 is a schematic flow chart of a CBR deciding method. First, FEED time of each seam length, table rise-delay time A and table moving time E are read (S251). However, FEED time of each seam length is not synchronized with sewing speed. Subsequently, a program enters a routine which executes computation within a CBR area (S252). Here, a minimum value C of the CBR is decided due to an operation equation $C=Tmin-A$, by a period of time Tmin from time at which the DN signal is outputted to time at which the forward end of the needle 202 passes out of the slide plate 207 (G1 in FIG. 24), and the table rise-delay time A. A maximum value D of the CBR is decided due to an operation equation $D=Tmax-(A+E)$, by the period of time Tmax from time at which the DN signal is outputted to time at which the forward end of the needle 202 passes into the slide plate 207 (G2 in FIG. 24), the table rise-delay time A, and the table moving time E. This processing is executed regarding all sewing speeds every seam length. Subsequently, the sizes or dimensions of C and D for all sewing speeds for each seam length are compared with each other (S253). If $0<C\leqq D$, the program branches to a step 255, while, if $C>D$, the program proceeds to a step 254. Subsequently, C is set such that $C=D$ (S254). All C and D of each seam length for every sewing speed are decided (S255) so that processing is ended.

Figure 6:
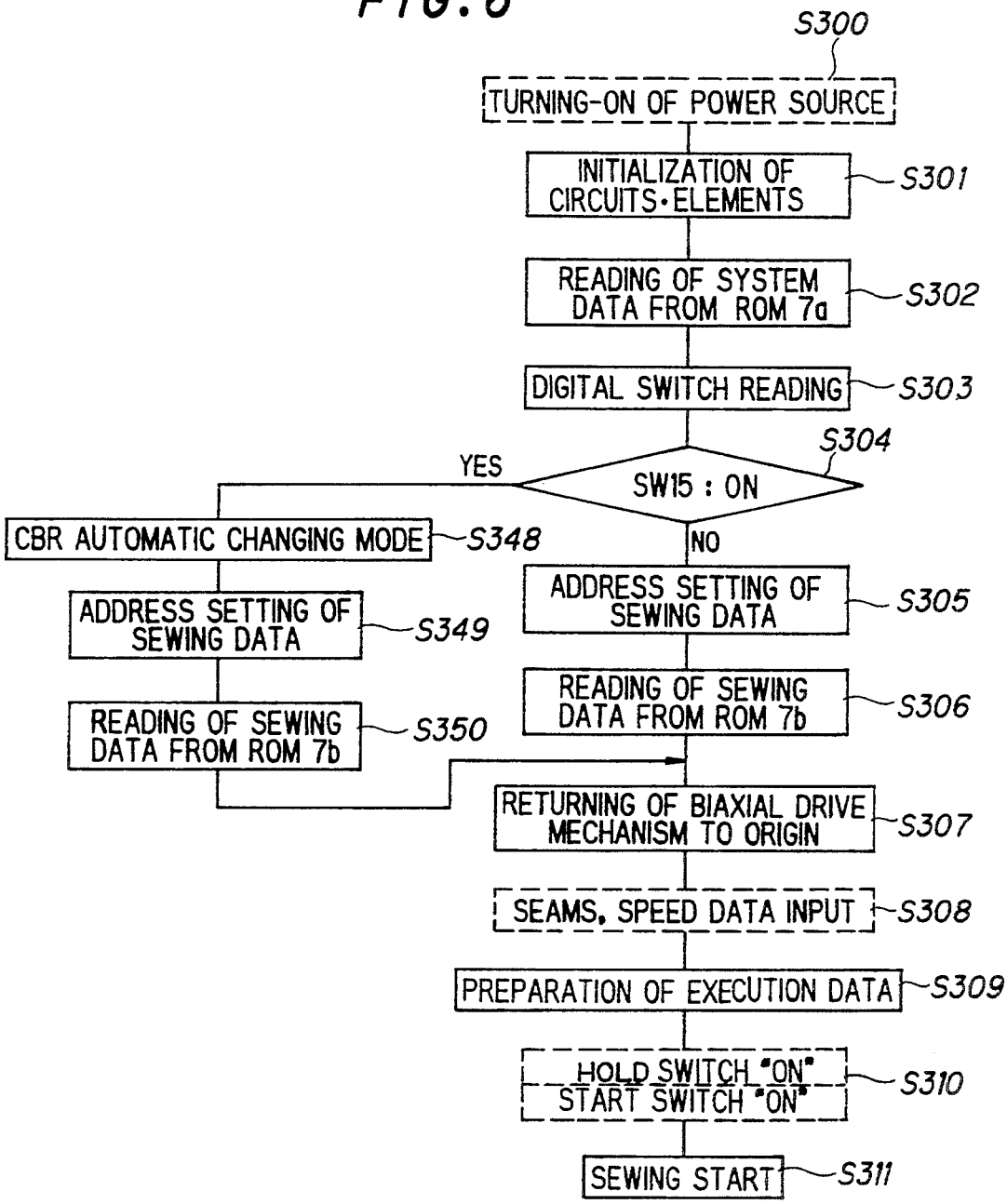
FIG. 6 is a flow chart showing operation from turning-on of a power source to sewing start, according to the invention.

FIG. 6 is a schematic flow chart showing operation from a time at which the power source is turned on to a time at which sewing operation starts. In this connection, step encircled by the solid lines in FIG. 6 indicate locations where the system executes, while steps encircled by the broken lines indicates locations where an operator executes. First, the power switch 211 of the control unit 209 is turned on (S300), to supply the electric power to the drive motor 24. When the electric power is supplied to all the elements and circuits within the control unit 209, the reset signal is outputted to the microcomputer 1. By the reset signal, the microcomputer 1 is initialized. Simultaneously, by outputting of the reset signal from the microcomputer 1, all the elements and the circuits are initialized (S301). After the reset signal has been released after a predetermined period of time, the microcomputer 1 stores the system data from the system area 7*a* within the ROM 7, to the memory within the microcomputer 1 (S302). Subsequently, a value of the digital switch is read which sets a value of the count borrow (S303). Subsequently, turning-on and -off conditions of the change-over switch 15 are read (S304). When the change-over switch 15 is turned on, the mode is changed to a CBR automatic changing mode. This CBR automatic changing mode will be described later. When the change-over switch 15 is turned off, addresses of the required data within the data area 7*b* of the ROM 7 are set (S305) and, subsequently, sewing data is computed and stored beforehand by the addresses, that is, the feed pulse data 220 of the bi-axial drive mechanism, the count-borrow data 221 and the speed-limit data 222 are stored in the data areas within the RAM 6*a/b/c* (S306).

Figures 7A, 7B:
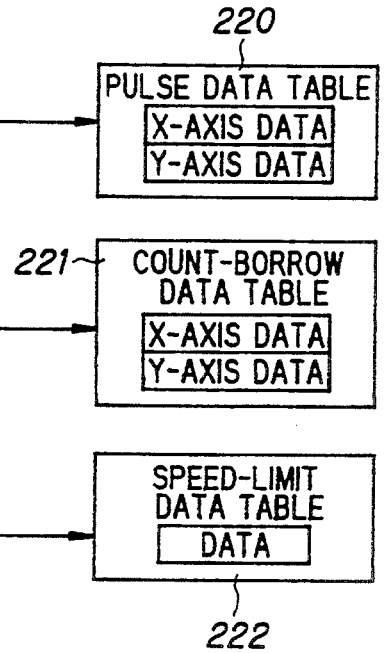
FIG. 7(*a*) and FIG. 7(*b*) are views for explanation showing an example of a count-borrow data table and a data arrangement of data areas within memory means, according to the invention.

Here, an embodiment of the data and the arrangement within the ROM 7*b* is shown in FIG. 7(*a*). The feed pulse data of the X-axis and the Y-axis are stored in the address (a). The count-borrow data of the X-axis and the Y-axis, which are constant regardless of the moving location and the moving direction of the work holding unit, are stored in addresses (b) and (c). The count-borrow data of the X-axis and the Y-axis, which are different from each other depending upon the moving location and the moving direction of the work holding unit in the CBR automatic changing mode, due to turning-on of the change-over switch 15, are stored in the addresses (e) (o). The speed-limit data and the FEED time data of the sewing machine, which correspond respectively to the count-borrow data in the addresses (b) and (c), are stored in the addresses (p) and (q).

Figure 16:
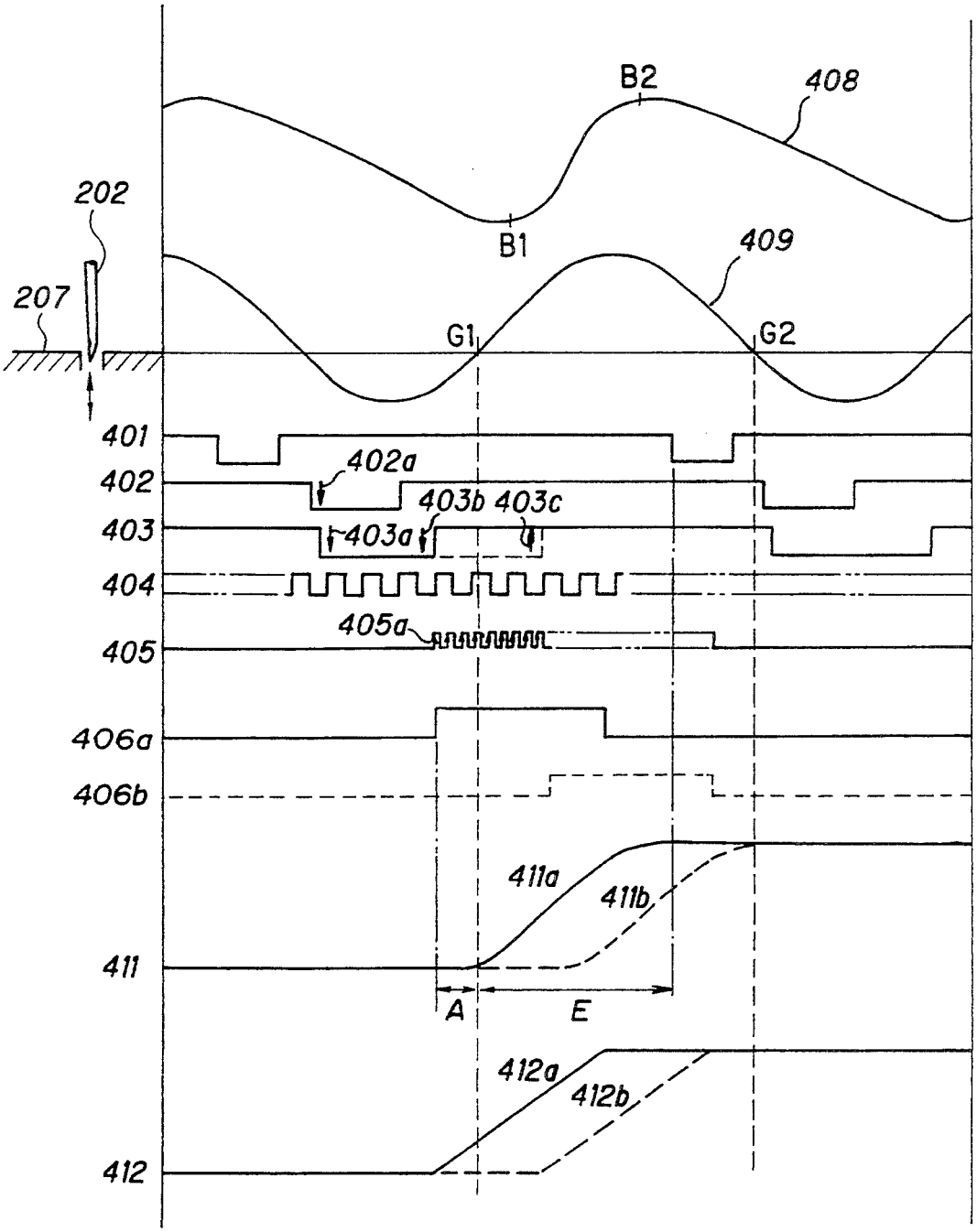
FIG. 16 is a timing chart showing operation timing of a bi-axial drive mechanism, according to the invention.

FIG. 7(*b*) is a table showing an example of the above-described count-borrow data table. Values in FIG. 7(*b*) are 50 100 at 0.1 mm and 2000 s/min, for example. However, 50 represents the minimum value C, while 100 represents the maximum value D. The CBR is capable of being changed within this range. If the CBR is 50, the BR signal 403 detecting the fall point 402*a* of the needle lower-position signal 402 in FIG. 16 is brought to "Low Active" (403*a*), to count the PG signal. When the count value of the PG signal becomes 50, the BR signal is brought to "High Active" (403*b*), to output the fundamental interrupt signal 405. In the stepping-motor drive signal 406, the solid line indicates the signal when the CBR is the minimum value C, while the broken line indicates the signal when the CBR is the maximum value D. These solid and broken lines correspond respectively to the solid and broken lines of the waveform 412 in which the moving locus 411 of the work holding unit and the stepping-motor drive processing are converted to the moving distance.

Figures 8, 9:
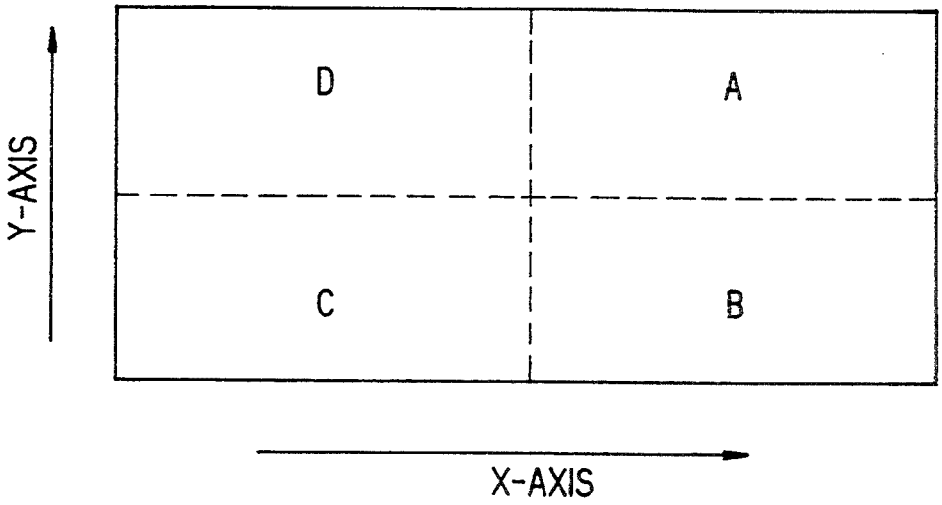
FIG. 8 is a view for explanation showing an example of division of a moving direction and a moving location of a work holding unit, according to the invention.
FIG. 9 is a graph showing a state of a flag corresponding to FIG. 8.

FIG. 8 shows a division of the moving location and the moving direction of the work holding unit corresponding to the CBR automatic changing mode due to turning-on of the change-over switch 15, while FIG. 9 shows states of flags corresponding thereto. FIG. 10 shows the relationship with respect to the moving location and the moving direction of the work holding unit illustrated in FIG. 8, corresponding to the count-borrow data tables (3) (15) illustrated in FIG. 7(*a*).

Now, when the sewing data are read into the RAM 6, the microcomputer 1 supplies signals to the PMD 13 to drive the stepping motors 27 and 28, in order to move the bi-axial drive mechanism to the origin. When the signals (OP in FIG. 1) of the origin from the respective origin detecting units 29 and 30 are inputted, the microcomputer 1 stops the stepping motors 27 and 28 (S307). The sewing pattern data, the sewing speed and the like are set by the operator (S308). These data and the aforesaid sewing data, that is, the feed pulse data 220, the count-borrow data 221 and the speed-limit data 222 are assembled as one data. Executable optimum sewing data are prepared (S309) and, subsequently, when the work holding switch 214 is turned on and the start switch 216 is turned on (S310), the sewing-machine head 25 is driven to start sewing the operation (S311).

Detailed description of the control operation of the bi-axial drive mechanism will next be made with reference to flow charts shown in FIGS. 11–14 and a timing chart shown in FIG. 16. As shown in FIG. 16, the reference numeral 403 denotes the BR signal, while the reference numeral 406 designates the stepping-motor drive signal of the X-axis. A waveform 411 shows the moving locus of the work holding unit 206 on the slide plate 207 in the X-direction, while a waveform 412 is one in which the stepping-motor drive processing is converted to the moving distance. In this connection, in the embodiment according to the invention, a case will be described where only one axis (X-axis) of the bi-axial drive mechanism is driven. Description of the case where both axes (both X-axis and Y-axis) move is similar to operation in which one axis is combined with the other axis, and will be omitted.

Figure 11:
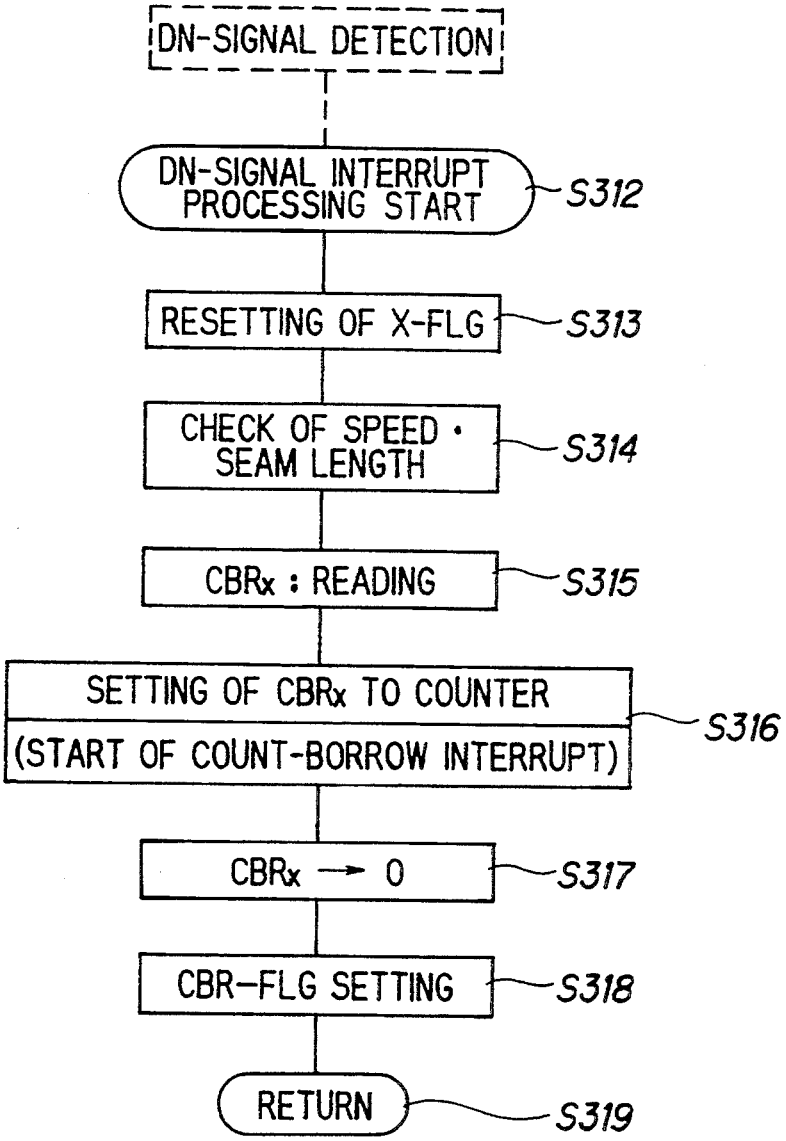
FIG. 11 is a flow chart showing DN-signal interrupt processing operation, according to the invention.

The sewing-machine head 25 is driven, and the DN signal is outputted from the detector 26, whereby the DN-signal interrupt processing illustrated in FIG. 11 starts (S312). First, a movement-permission flag X-FLG of the X-axis is reset so as to be brought to a movement inhibiting state (S313). subsequently, the sewing speed and the sewing length of next one stitch are read to a memory stack within the microcomputer 1 (S314). The sewing speed and the sewing length as well as the pulse number CBRx of the X-axis corresponding to the digital switch are read from the RAM 6 into the memory stack within the microcomputer 1 (S315). The CBRx is set into the down counter 101 from the I/O 8 through the data buffer 4 illustrated in FIG. 19 (S316). Immediately thereafter, the CBRx is cleared (S317). A count-borrow-processing interrupt permission flag CBR-FLG is set (S318), to leave the DN-signal interrupt processing routine (S319).

Figure 19:
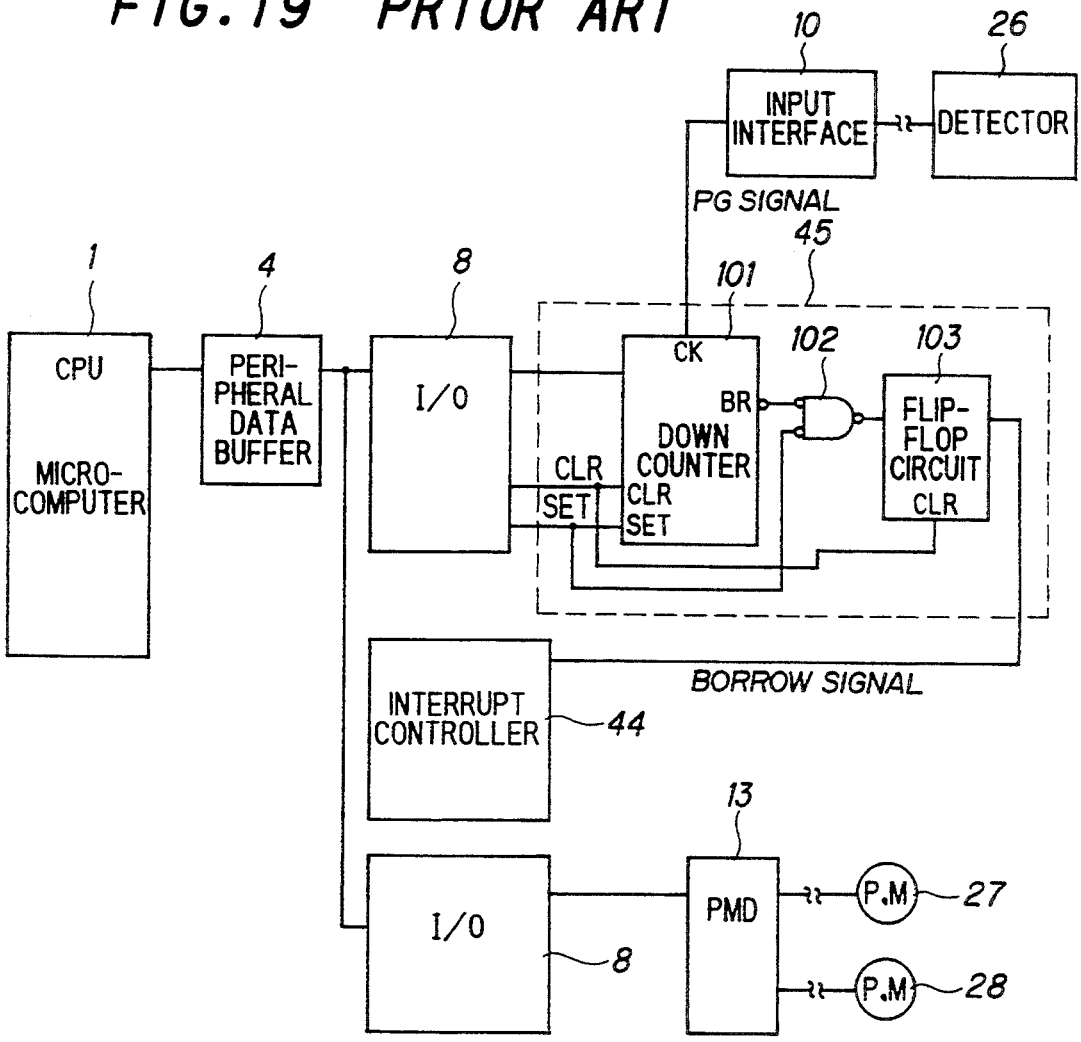
FIG. 19 PRIOR ART
FIG. 19 is a block diagram showing an arrangement of a count-borrow circuit illustrated in FIG. 18.
Figure 21:
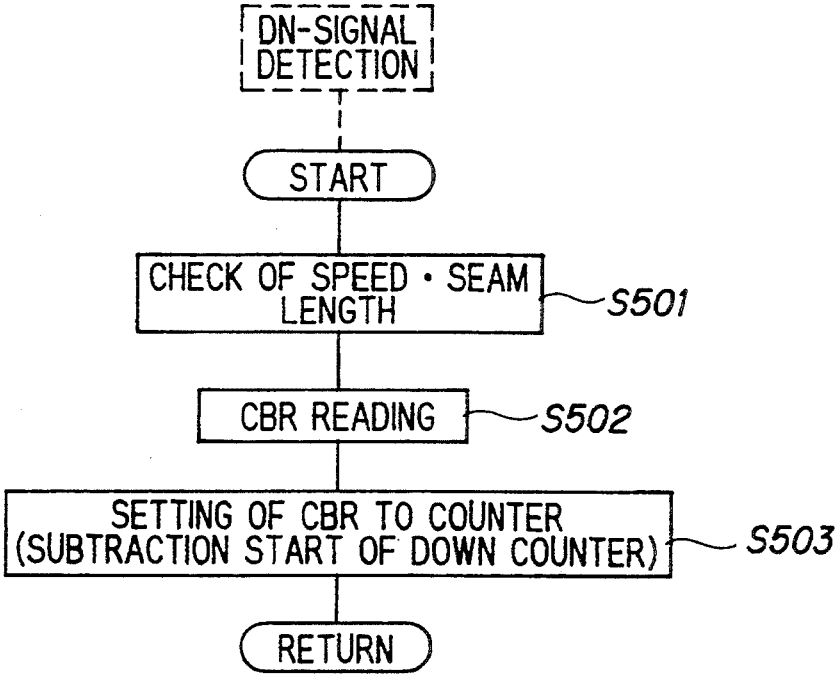
FIG. 21 PRIOR ART
FIG. 21 is a flow chart showing DN-signal interrupt processing operation in the conventional arrangement.
Figure 22:
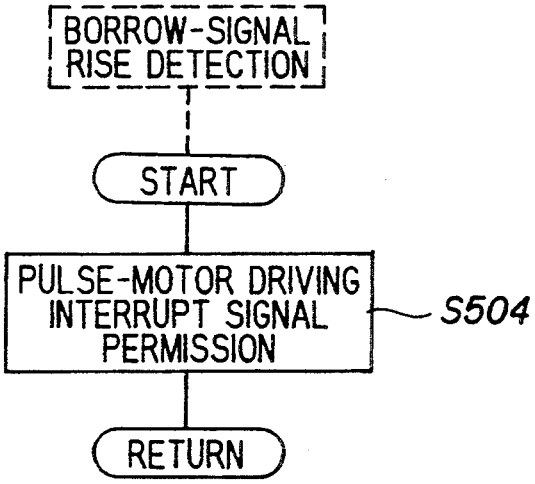
FIG. 22 PRIOR ART
FIG. 22 is a flow chart showing count-borrow interrupt processing operation in the conventional arrangement.
Figure 23:
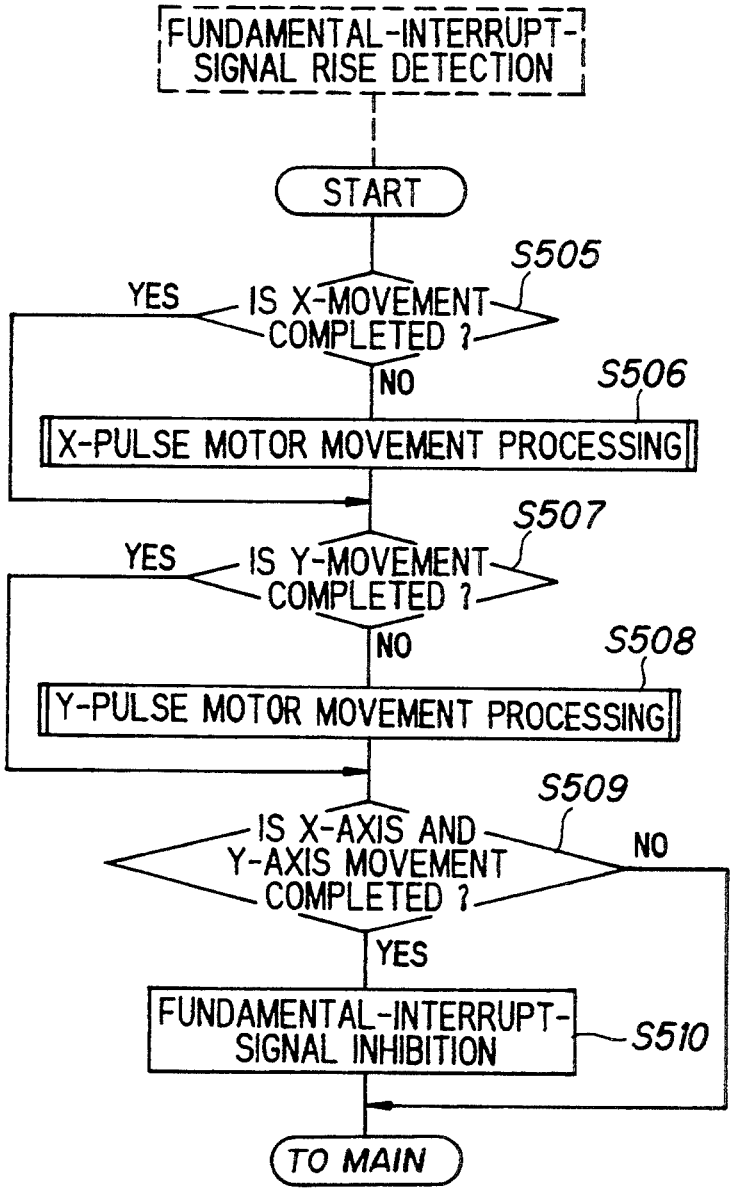
FIG. 23 PRIOR ART
FIG. 23 is a flow chart showing X- and Y-table movement processing operation in the conventional arrangement.

Here, in the microcomputer 1 illustrated in FIG. 19, the pulse number CBRx is set to the down counter 101 and, simultaneously therewith, the BR signal 403 that is the output from the flip-flop circuit 103 is inverted so as to be brought to "Low Level". This state is indicated by the reference numeral 403*a* in FIG. 16. The contents of the counter are subtracted whenever the PG signal 404 is inputted from the detector 26 through the input interface 10. As the result of the subtraction is brought to 0 (zero), the down counter 101 outputs a pulse signal to the flip-flop circuit 103 through the OR circuit 102. By doing so, the BR signal that is the output from the flip-flop circuit 103 is inverted so as to be brought to "High Level". This state is indicated by the reference numeral 403*b* in FIG. 16.

Figure 12:
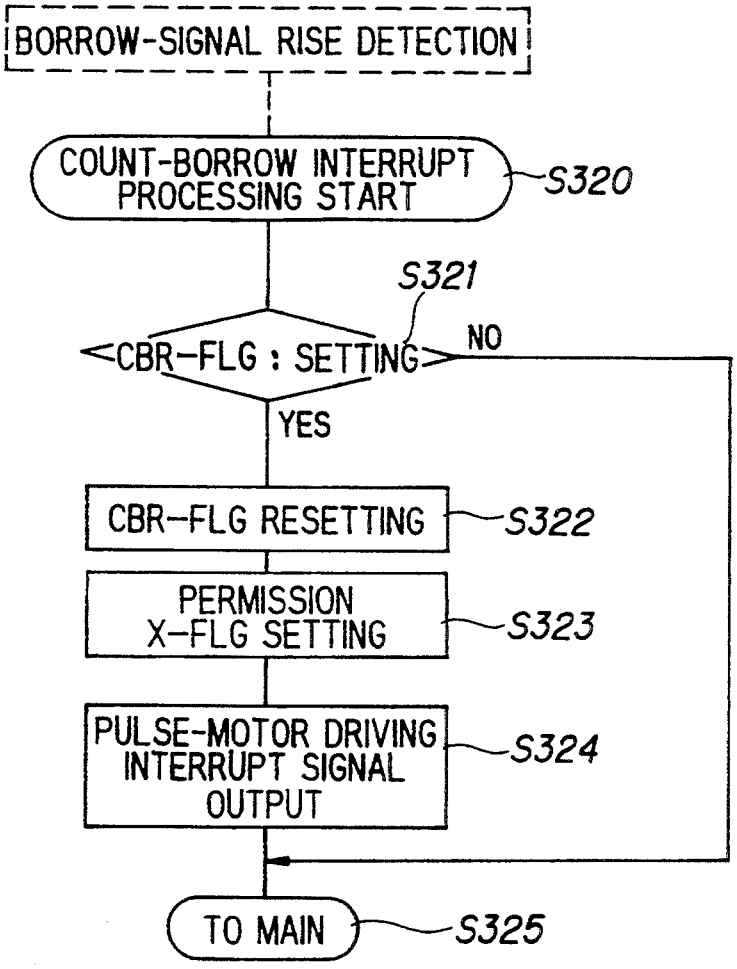
FIG. 12 is a flow chart showing count-borrow interrupt processing operation, according to the invention.
Figure 13:
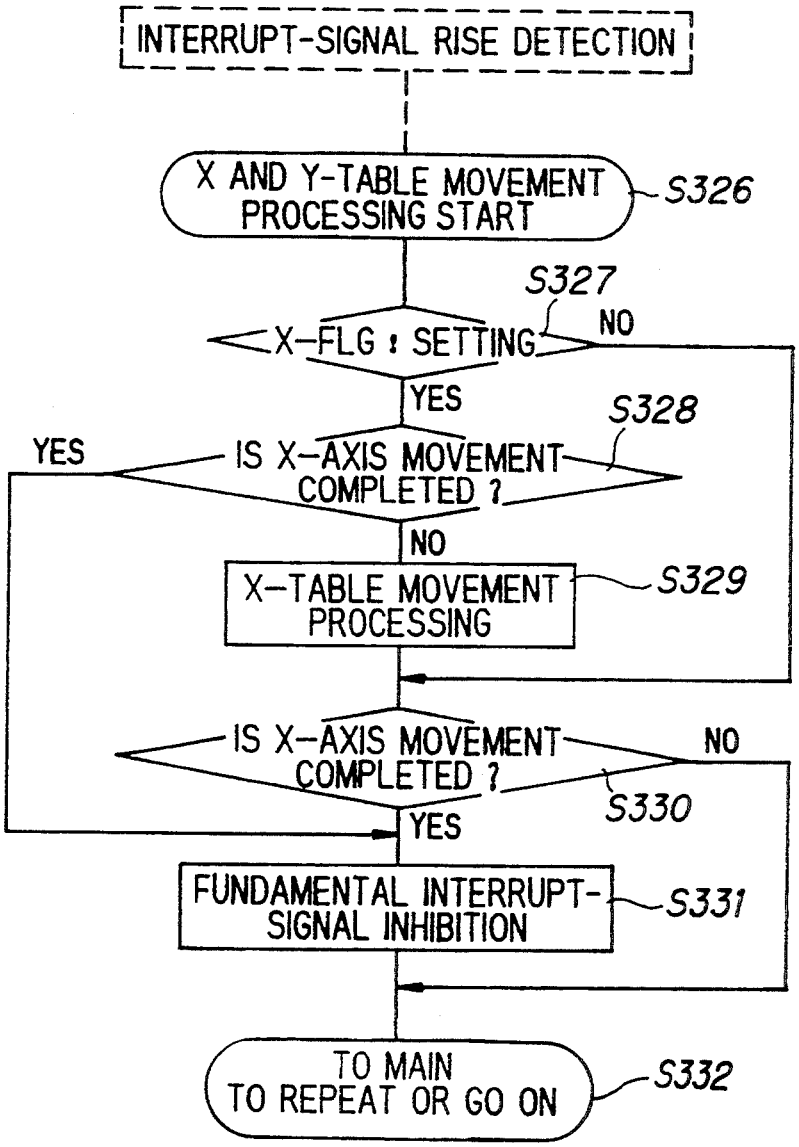
FIG. 13 is a flow chart showing X- and Y-table-movement processing operation, according to the invention.

By the fact that the BR signal is brought to "High Level", the interrupt controller 44 applies interrupt to the processing of the microcomputer 1. By the interrupt, the microcomputer 1 starts the count-borrow interrupt processing illustrated in FIG. 12 (S320). Subsequently, it is judged whether or not the count-borrow-processing interrupt permission flag CBR-FLG is set (S321). Since the flag is set in a flow from the DN-signal interrupt processing illustrated in FIG. 11, the program proceeds to the step 322. Since the CBRx is 0, the FLG is again set (S322), and the X-axis movement permission flag X-FLG is set (S323). Subsequently, outputting from the stepping-motor-driving fundamental interrupt signal 405 is permitted (S324), to finish the count-borrow interrupt processing as shown in FIG. 12. This state is indicated by the reference numeral 405*a* in FIG. 16.

When outputting of the stepping-motor-driving fundamental interrupt signal 405 is permitted, the interrupt signal 405 continues to be issued until outputting is inhibited. Whenever a rise point 405*a* of the interrupt signal is detected, the microcomputer 1 starts the X- and Y-table movement processing illustrated in FIG. 13 (S326). In this routine, it is first judged whether or not the X-FLG is set, that is, movement of the X-axis is permitted (S327). If the X-FLG is not set, the program branches to a step S330, while, if the X-FLG is set, the program proceeds to a step S328. In step S328, it is judged whether or not the movement of the X-axis is completed, that is, movement corresponding to the sewing length of set one stitch is completed (S328). If the movement of the X-axis is completed, the program branches to a step S331, while, if the movement of the X-axis is not completed, the program proceeds to the subroutine for X- and Y-table movement processing to move the X-axis drive mechanism (S329). Next, it is judged whether or not the X-axis completes movement (S330). If the movement is completed, outputting of the stepping-motor-driving fundamental interrupt signal is inhibited (S331), to leave the X- and Y-table movement processing (S332). If the movement is not completed the program proceeds to a step S332. As described above, the X- and Y-table movement processing is repeatedly executed until the length corresponding to the sewing length of the set one stitch is moved, that is, during the period of time in which 406 in FIG. 16 is outputted. If the movement is completed, by the inhibition of outputting of the fundamental interrupt signal 405, the program does not enter this routine, until outputting of the fundamental interrupt signal 405 is again permitted.

Figure 26:
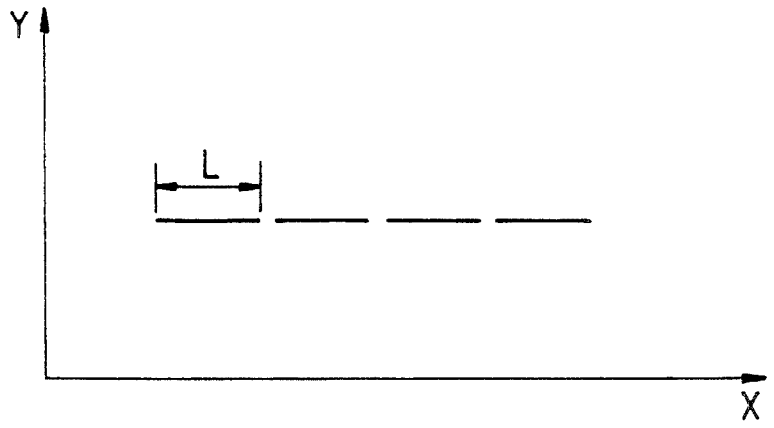
FIG. 26 PRIOR ART
FIG. 26 is a view for explanation showing drive processing of a work holding unit and a sewing pattern for the description of movement of the work holding unit.

As described above, by the control apparatus for the automatic sewing machine, according to the invention, the movement locus of the work holding unit 206 in the X-axis direction is brought to one like 411 in FIG. 16, when a sewing operation is executed to form the sewing pattern illustrated in FIG. 26. The reference numeral 411*a* denotes the moving locus of the work holding unit in the case where the CBRx is C, while the reference numeral 411*b* designates the moving locus of the work holding unit in the case where the CBRx is D. By the fact that the CBRx is changed within the range of from c D by the digital switch, it is possible to change the work holding unit 206 within a range of from 411*a* 411*b*.

FIG. 8 shows an embodiment in which the moving direction and the moving location of the work holding unit are divided. FIG. 9 shows a state of the flag corresponding to the moving direction and moving location of the work holder illustrated in FIG. 8. FIG. 10 shows an arrangement of the count-borrow data within the corresponding ROM *7b*. Here, in the case where, in FIG. 8, the moving location of the work holding unit is 'A', the moving direction is a positive direction of the X-axis, and the Y-axis stops, the state of the flags (XP-FLG, XN-FLG, YP-FLG and YN-FLG) (hereinafter referred to as "moving-state flags") is (1, 0, 1, 1). Here, the XP-FLG is the flag indicating the positive moving direction of the X-axis, the XN-FLG is the flag indicating the negative moving direction of the X-axis, the YP-FLG is the flag indicating the positive moving direction of the Y-axis, and the YN-FLG is the flag indicating the negative moving direction of the Y-axis. All the flags can not take the same value. By the condition of the flags, the count-borrow data within the ROM *7b* is brought to a condition in which the data of the address (d) are read as shown in FIG. 10.

Operation of the above-described embodiment will next be described. First, in the flow chart shown in FIG. 6, the operations from the step S300 to the step S303 are as described previously. In the step S304, when the change-over switch 15 is turned on, the program enters the CBR automatic changing mode (S348). Subsequently, address of the required data within the data area ROM *7b* of the ROM 7 is set (S349). At this time, the read data are the feed pulse data 220 and the speed limit data 222, but the count-borrow data 221 are not read. Subsequently, the sewing data beforehand computed and stored by the address, that is, the feed pulse data 220 of the bi-axial drive mechanism and the speed limit data 222, are stored in the data area within the RAM 6 (S350).

Figure 14:
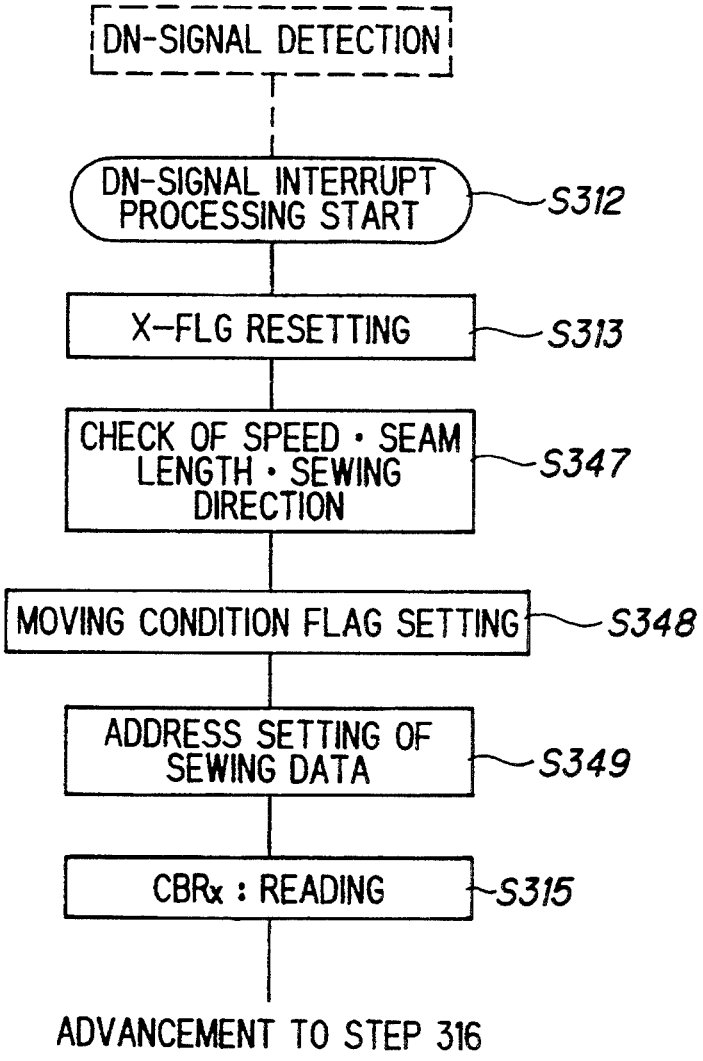
FIG. 14 is a flow chart showing DN-signal interrupt processing operation, according to the invention.

FIG. 14 shows a flow chart of the DN-signal interrupt processing in the case where the work holding unit according to the above-described embodiment moves only along the X-axis. In FIG. 14, steps like or similar to those in the other embodiments are designated by the same reference numerals, and the description of the like or similar steps will be omitted. Further, the stepping-motor drive processing and the X- and Y-table movement processing are also similar to those in the aforesaid other embodiments, and the description thereof will be omitted. As shown in FIG. 14, the DN signal is detected, the DN-signal interrupt processing starts, the X-axis movement permission flag X-FLG is reset, and the condition is brought the movement inhibiting condition (S312, S313). The sewing speed, the sewing length and the sewing direction of the subsequent one stitch are read into the stack within the microcomputer 1 (S347). Subsequently, the microcomputer 1 sets the moving state flag by the positions of the stepping-motor origin detecting units 29 and 30 illustrated in FIGS. 8 and 9 and the sewing direction of the subsequent one stitch read in the step S347 (S348). Subsequently, the microcomputer 1 fetches, into the stack, the count-borrow data corresponding to the moving state flag illustrated in FIG. 10, and sets the pulse number corresponding to the sewing speed and the sewing length of the sewing machine and the addresses in which the speed limit is stored, from the count-borrow table and the speed limit table 222 (S349). Thus, the microcomputer 1 reads the $CBR_x$ (S315).

Figure 15:
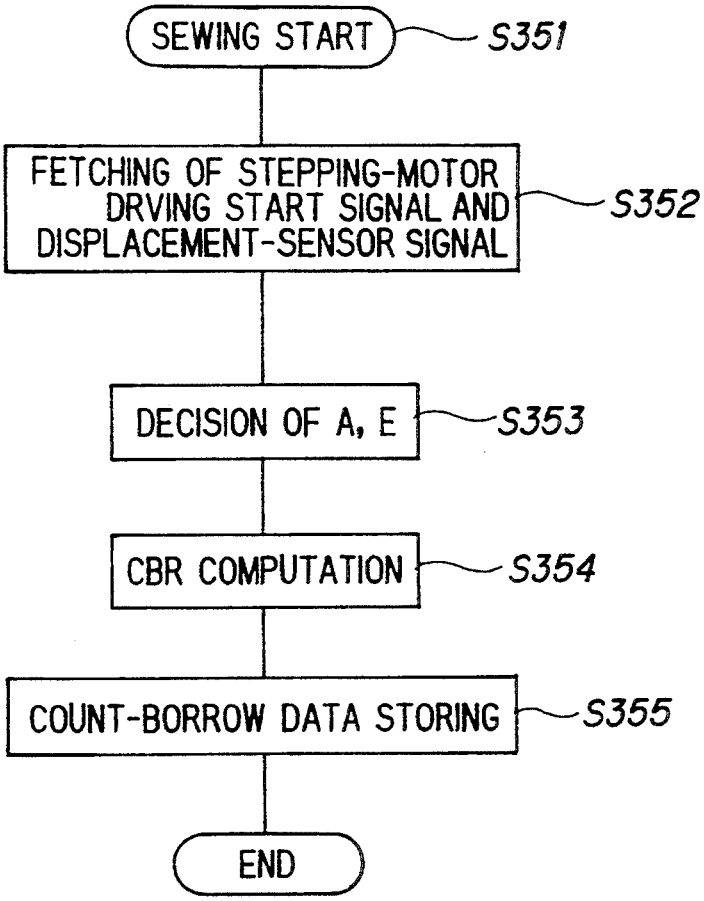
FIG. 15 is a flow chart showing processing operation for a delay-pulse-number deciding method, according to the invention.

Operation of another embodiment will further be described. In this embodiment, flow from the time the power source is turned on to the time the sewing operation starts is similar to one in the above-described embodiments, and the description of the flow will be omitted. FIG. 15 is a schematic flow chart showing the operation for drive-timing decision of the work holding drive section which corresponds to various sewing patterns in this embodiment. As sewing starts in accordance with the sewing patterns (S351), the microcomputer 1 fetches, into the memory stack, a time at which the stepping-motor drive signal is outputted, a time at which the work holding unit starts movement from the displacement sensors 55 and 56 illustrated in FIG. 3, and a time at which movement of the work holding unit is completed (S352). The microcomputer 1 executes computation of time (table rise-delay time A) from outputting of the stepping-motor drive signal to starting of the movement of the work holding unit, and a time (table moving time E) of movement of the work holding unit, to decide the same (S353). This processing is executed for every seam of the sewing pattern. Subsequently, the CBR range or area every speed of all the seams is computed (S354). This CBR computation method is similar to that in the aforementioned embodiments. The count-borrow data are stored in the memory means in which the sewing pattern data are stored so as to correspond to each seam of the sewing pattern data (S355). Subsequent sewing operations are similar to those in the above-described embodiments.

In the embodiments described above, reading of the sewing data corresponding to one stitch and setting of the delay pulse number are executed by application of a trigger to the fall point of the needle-bar lower-position signal. If the signal is a signal in synchronism with rotation of a spindle of another sewing machine, however, it is needless to say that similar operation is possible. Further, a mechanism for generating the BR signal is composed by hardware (hereinafter referred to as "H/W"). However, the arrangement may be such that the PG signal is recognized by the microcomputer 1 due to the interrupt signal or the like, the PG signal is counted by software (hereinafter referred to as "S/W"), and activation timing of the bi-axial drive mechanism is decided.

Furthermore, in the above-described embodiments, reading of the change-over switch is executed at rise of the power source. However, reading timing of the change-over switch may be executed in any cases before the sewing operation starts. Moreover, change-over means may be a switch due to the H/W and, in addition thereto, a switch due to the S/W by setting from the operating panel, for example.

Further, in the above-described embodiments, the data table within the ROM are once transmitted into the RAM at rise of the power source. However, this is merely executed in order to facilitate debugging processing, and there is no inconvenience that the data table is read directly to the microcomputer from the ROM at sewing. Furthermore, a location where the sewing data are stored is not limited to the ROM, but the data may be transmitted by communication from a memory medium such as a floppy disc, and from a personal computer or the like.

Moreover, in the present invention, the stepping motors are preferred as the motor for driving the work holding unit. If, however, the table rise-delay time and the table movement time are capable of being recognized, any motor may be utilized. Further, it is unnecessary for the sewing machine to compute the table rise-delay time and the table movement time, but the arrangement may be such that the times are set by beforehand execution of analysis of the drive system. Furthermore, in the CBR automatic changing mode, the moving direction and the moving location of the work holding unit are divided as illustrated in FIG. 8. However, these may be divided in any manner. Moreover, the displacement sensors illustrated in FIG. 3 are used as work-holding-unit movement detecting means. However, any other means may be used as the displacement sensors, if the means can detect movement of the work holding unit in real time by a motor shaft or the like.

Further, in the above-described embodiments, the sewing machine has been described in which the sewing material is fed by the work holding unit, to form the seams. However, this control can be executed if a sewing machine in which the sewing material stops to move a sewing machine head thereby forming the seams is substituted for the first-mentioned sewing machine.

Furthermore, timing from start of the movement of the work holding unit to termination of the movement can be controlled by the position of the needle so that optimum work holding drive timing can be produced. Since the drive control data are automatically selected by the signal from the means for detecting the moving directions and the moving locations of the stepping motors for bi-axial driving, optimum work-holding drive control can be made possible, regardless of the moving direction and the moving location of the work holding unit. Moreover, since the activation timing data of the bi-axial drive mechanism are generated every sewing pattern and are stored in the sewing-pattern data, it is possible to provide drive control data optimum for the sewing pattern, and it is possible to save the data area for the activation timing.

Although the invention has been described with respect to specific embodiments for a complete and clear disclosure, the appended claims are not to be thus limited but are to be construed as embodying all modifications and alternative constructions that may occur to one skilled in the art which fairly fall within the basis teaching herein set forth.

What is claimed is:

1. A method of controlling an automatic sewing machine, comprising a driveable work holding means which is operative for clamping a cloth and is moveable in response to stored sewing pattern data to sew in a sewing pattern, comprising the steps of:

defining a first time period extending from the time that a start signal for operating said work holding means is output to a time at which said work holding means starts moving, and defining a second time period beginning when said work holding means begins to move and ending when said work holding means has finished moving; and moving a sewing needle into and out of a piece of work material, outputting said start signal from a drive control means at the beginning of said first time period, wherein said start time corresponds to a time before the needle is moved out of said work material, driving said work holding means upon completion of said first time period;

wherein said first time period is calculated based on both (a) the time required for a drive motor to begin rotation once a drive pulse is output, and (b) the time required for the work holding means to begin moving once the drive motor has begun rotating.

2. A sewing machine control method as set forth in claim 1, further comprising:

performing said defining steps on a per-seam basis and for every seam in a sewing pattern.

3. A sewing machine control method as set forth in claim 1, further comprising:

computing a number of pulses corresponding to a sewing speed and a sewing length at which a processing is ended when a forward end of a needle passes through a slide plate for every speed for all seams.

4. A sewing machine control method as set forth in claim 1, further comprising:

storing count borrow data in correspondence with sewing pattern data for each seam.

5. A sewing machine control method as set forth in claim 1, further comprising:

detecting at least one of the moving direction and the moving location of said work holding means; and changing the timing of the at least one of said first and second periods in response to said at least one of the detected moving direction and moving location.

6. A sewing machine control method as set forth in claim 1, further comprising:

performing said setting steps at the time of driving said work holding means.

7. A method of controlling an automatic sewing machine in response to a stored program, said machine comprising a spindle, a needle, and a work holder that is operative to hold a work piece and is driveable to a predetermined position in response to stored sewing pattern data, comprising:

detecting the retrieval of stored sewing pattern data; generating a timing change signal in relation to at least one of moving direction and moving location information in said data;

detecting the position of said needle; and changing the timing of the driving of said work holder specified by said stored sewing pattern data in response to said timing change signal and said needle detecting step;

wherein said timing change signal is calculated based on both (a) the time required for a drive motor to begin rotation once a drive pulse is output, and (b) the time required for the work holding means to begin moving once the drive motor has begun rotating.

8. A sewing machine control method as set forth in claim 7, further comprising:

performing said changing steps on a per-seam basis and for every seam in a sewing pattern.

9. A sewing machine control method as set forth in claim 7, further comprising:

computing a number of pulses corresponding to a sewing speed and a sewing length at which a processing is ended when a forward end of a needle passes through a slide plate for every speed for all seams.

10. A sewing machine control method as set forth in claim 7, further comprising:

storing count borrow data in correspondence with sewing pattern data for each seam.

11. An apparatus for controlling an automatic sewing machine in response to a stored program, said machine comprising a spindle, a needle, and a work holder that is operative to hold a work piece and is driveable to a predetermined position in response to stored sewing pattern data, comprising:

control means for controlling a plurality of sections of said sewing machine;

first memory means for storing a program for controlling said control means;

second memory means for storing sewing pattern data, comprising at least one of sewing speed and sewing length data;

work holder driving means, comprising a driver means, for moving said workholder to a predetermined position in response to sewing pattern data;

pulse generator signal generating means for outputting a pulse generator signal at predetermined intervals in response to the rotation of said spindle;

count borrow means for transmitting notice of a sewing pattern data output from said second memory for operating said work holder driving means in response to said pulse generator signal; and work holder movement detecting means for detecting a movement direction and a moving location of said work holder means;

wherein said control means regulates driving of said work holder and changes the timing at which said work holder is driven, on the basis of at least one of said detected moving direction and said moving location of said work holder wherein said timing is determined based on both (a) the time required for a drive motor to begin rotation once a drive pulse is output, and (b) the time required for the work holder to begin moving once the drive motor has begun rotation.

12. An apparatus for controlling an automatic sewing machine, according to claim 11, further comprising:

needle position detecting means for detecting a needle position of the sewing machine and generating a needle position signal; and wherein said control means controls the movement timing of said work holding means on the basis of said needle position signal.

13. An apparatus for controlling an automatic sewing machine in response to a stored program, said machine comprising a spindle, a needle, and a work holder that is operative to hold a work piece and is driveable to a predetermined position in response to stored sewing pattern data, comprising:

control means for controlling a plurality of sections of said sewing machine;

first memory means for storing a program for controlling said control means;

second memory means for storing sewing pattern data, comprising at least one of sewing speed and sewing length data;

work holder driving means, comprising a driver means, for moving said workholder to a predetermined position in response to sewing pattern data;

pulse generator signal generating means for outputting a pulse generator signal at predetermined intervals in response to the rotation of said spindle;

count borrow means for transmitting notice of a sewing pattern data output from said second memory for operating said work holder driving means in response to said pulse generator signal; and work holder movement detecting means for detecting a movement direction and a moving location of said work holder;

wherein said control means regulates the execution of at least one of an actual and a simulated sewing operation to determine the drive timing of said work holder wherein said drive timing is determined based on both (a) the time required for a drive motor to begin rotation once a drive pulse is output, and (b) the time required for the work holder to begin moving once the drive motor has begun rotation.

14. An apparatus for controlling an automatic sewing machine, according to claim 13, further comprising:

needle position detecting means for detecting a needle position of the sewing machine and generating a needle position signal; and wherein said control means controls the movement timing of said work holding means on the basis of said needle position signal.

15. An apparatus for controlling an automatic sewing machine in response to a stored program, said machine comprising a spindle, a needle, and a work holder that is operative to hold a work piece and is driveable to a predetermined position in response to stored sewing pattern data, comprising:

control means for controlling a plurality of sections of said sewing machine;

first memory means for storing a program for controlling said control means;

second memory means for storing sewing pattern data, comprising at least one of sewing speed and sewing length data;

work holder driving means, comprising a driver means, for moving said workholder to a predetermined position in response to sewing pattern data;

pulse generator signal generating means for outputting a pulse generator signal at predetermined intervals in response to the rotation of said spindle;

count borrow means for transmitting notice of sewing pattern data output from said second memory for operating said work holder driving means in response to said pulse generator signal; and work holder movement detecting means for detecting a movement direction and a moving location of said work holding means;

wherein said control means regulates the driving of said work holder and changes the timing of said driving on the basis of at least one of said movement direction and said movement location of said work holder, and said control means regulates the execution of at least one of an actual and a simulated sewing operation to determine the drive timing of said work holding means wherein said timing is determined based on both (a) the time required for a drive motor to begin rotation once a drive pulse is output, and (b) the time required for the work holding means to begin moving once the drive motor has begun rotation.

16. An apparatus for controlling an automatic sewing machine, according to claim 15, further comprising:

needle position detecting means for detecting a needle position of the sewing machine and generating a needle position signal; and wherein said control means is operative to drive said work holding means and control the movement timing of said work holding means on the basis of said needle position signal.

* * * * *